US012369640B2

(12) United States Patent
Alarcon et al.

(10) Patent No.: US 12,369,640 B2
(45) Date of Patent: Jul. 29, 2025

(54) ELECTRONIC CIGARETTE BACKFLOW MITIGATION VALVE

(71) Applicant: Fontem Holdings 1 B.V., Amsterdam (NL)

(72) Inventors: Ramon Alarcon, Los Gatos, CA (US); Dennis Rasmussen, Campbell, CA (US)

(73) Assignee: Fontem Ventures B.V., Amsterdam (NL)

( * ) Notice: Subject to any disclaimer, the term of this patent is extended or adjusted under 35 U.S.C. 154(b) by 496 days.

(21) Appl. No.: 17/620,537

(22) PCT Filed: Jun. 18, 2020

(86) PCT No.: PCT/IB2020/055756
§ 371 (c)(1),
(2) Date: Dec. 17, 2021

(87) PCT Pub. No.: WO2020/255044
PCT Pub. Date: Dec. 24, 2020

(65) Prior Publication Data

US 2022/0312852 A1 Oct. 6, 2022

Related U.S. Application Data

(60) Provisional application No. 62/864,154, filed on Jun. 20, 2019.

(51) Int. Cl.
*A24F 40/485* (2020.01)

(52) U.S. Cl.
CPC ..... *A24F 40/485* (2020.01)

(58) Field of Classification Search
CPC ..... A24F 40/485; A24F 40/40; A24F 40/42; A24F 40/10
See application file for complete search history.

(56) References Cited

U.S. PATENT DOCUMENTS

| | | | | |
|---|---|---|---|---|
| 9,918,496 | B2 * | 3/2018 | Kane | A24F 40/485 |
| 10,034,495 | B2 * | 7/2018 | Alarcon | A61M 15/06 |
| 10,542,780 | B2 * | 1/2020 | Chung | A24F 40/485 |
| 11,026,451 | B2 * | 6/2021 | Wensley | F04B 19/00 |
| 11,571,024 | B2 * | 2/2023 | Biel | A24F 40/485 |
| 2014/0355969 | A1 * | 12/2014 | Stern | A24F 40/485 392/404 |
| 2015/0027470 | A1 * | 1/2015 | Kane | A24F 40/485 131/328 |

(Continued)

FOREIGN PATENT DOCUMENTS

| | | | |
|---|---|---|---|
| EP | 3275323 | A2 | 1/2018 |
| WO | 2016/103202 | A1 | 6/2016 |

*Primary Examiner* — Hae Moon Hyeon
(74) *Attorney, Agent, or Firm* — Dykema Gossett PLLC

(57) ABSTRACT

Various embodiments of the present disclosure can include an electronic cigarette. The electronic cigarette can include a body portion, the body portion including a body proximal end and a body distal end, wherein the body portion includes an air inlet. The electronic cigarette can include a mouthpiece connected to the body proximal end. The electronic cigarette can include an atomizer disposed in the body portion. The electronic cigarette can include a backflow mitigation valve disposed in the electronic cigarette, wherein the backflow mitigation valve is closed in a naturally biased state.

17 Claims, 16 Drawing Sheets

(56) References Cited

U.S. PATENT DOCUMENTS

| | | | | |
|---|---|---|---|---|
| 2016/0095355 | A1 | 4/2016 | Hearn | |
| 2016/0270446 | A1* | 9/2016 | Shenkal | H05B 3/40 |
| 2018/0020730 | A1* | 1/2018 | Alarcon | A24F 40/42 131/329 |
| 2018/0343925 | A1* | 12/2018 | Wensley | F04B 19/00 |
| 2019/0166907 | A1* | 6/2019 | Chung | A24F 40/485 |

* cited by examiner

ELECTRONIC CIGARETTE BACKFLOW MITIGATION VALVE

BACKGROUND a. Field of the Disclosure

This disclosure relates to an electronic cigarette backflow mitigation valve.

b. Background Art

Electronic cigarettes are a popular alternative to traditional smoking articles that burn tobacco products to generate mainstream smoke for inhalation. Unlike traditional tobacco-based smoking articles, electronic cigarettes generate an aerosol-based vapor for inhalation, which can generally emulate mainstream smoke of traditional tobacco based smoking articles. However, it is generally recognized that aerosol-based vapor generated by electronic cigarettes may not deliver the same "quality" of experience as traditional smoking articles.

As a user inhales (e.g., puffs) on an electronic cigarette, air can be drawn into the device through an air inlet. An atomizer can be activated and can generate a vapor from liquid stored in the electronic cigarette. The vapor can be carried through the electronic cigarette via the airflow generated by the user inhaling. Some electronic cigarettes can draw air through a battery portion of the electronic cigarette. In some cases, if a user exhales into the electronic cigarette, air, vapor, and/or condensed vapor and/or water droplets can be expelled from the air inlet an into a battery portion of the electronic cigarette or over sensitive electronic components associated with the electronic cigarette.

SUMMARY

Various embodiments of the present disclosure can include an electronic cigarette. The electronic cigarette can include a body portion, the body portion including a body proximal end and a body distal end, wherein the body portion includes an air inlet. The electronic cigarette can include a mouth piece connected to the body proximal end. The electronic cigarette can include an atomizer disposed in the body portion. The electronic cigarette can include a backflow mitigation valve disposed in the electronic cigarette, wherein the backflow mitigation valve is closed in a naturally biased state.

Various embodiments of the present disclosure can include an electronic cigarette. The electronic cigarette can include a body portion, the body portion including a body proximal end and a body distal end, wherein the body portion includes an air inlet. The electronic cigarette can include a mouth piece connected to the body proximal end. The electronic cigarette can include an atomizer disposed in the body portion. The electronic cigarette can include a battery portion connected to the body distal end via a battery connector. The electronic cigarette can include a backflow mitigation valve disposed in the battery connector.

Various embodiments of the present disclosure can include an electronic cigarette. The electronic cigarette can include a body portion, the body portion including a body proximal end and a body distal end, wherein the body portion includes an air inlet. The electronic cigarette can include a mouth piece connected to the body proximal end. The electronic cigarette can include an atomizer disposed in the body portion. The electronic cigarette can include a battery portion connected to the body distal end via a battery connector. The electronic cigarette can include a backflow mitigation valve disposed in the battery connector, wherein the backflow mitigation valve is formed from a flexible material, and wherein the backflow mitigation valve is closed in a naturally biased state.

BRIEF DESCRIPTION OF THE DRAWINGS

In the drawings, the same element numbers indicate the same elements in each of the views.

DETAILED DESCRIPTION

Figure 1:
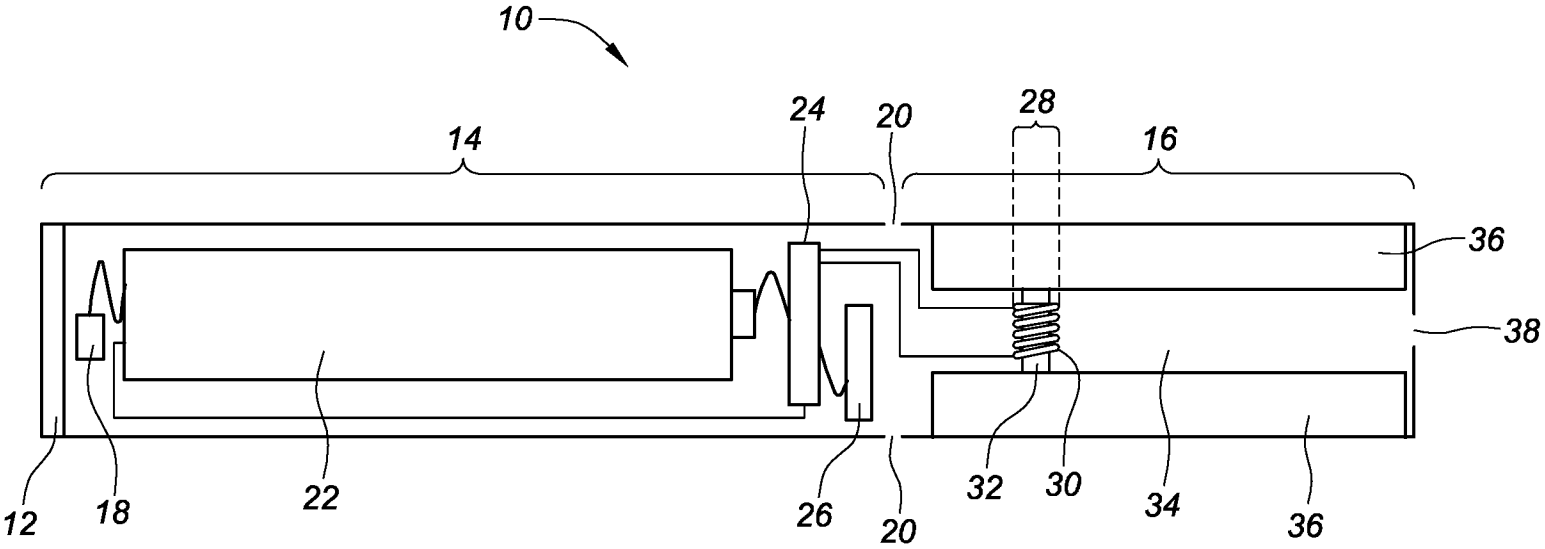
FIG. 1 is a schematic cross-sectional illustration of an exemplary e-cigarette.

Throughout the following, an electronic smoking device will be exemplarily described with reference to an e-cigarette. As is shown in FIG. 1, an e-cigarette 10 (also referred to herein as electronic smoking device) typically has a housing comprising a cylindrical hollow tube having an end cap 12. The cylindrical hollow tube may be a single-piece or a multiple-piece tube. In FIG. 1, the cylindrical hollow tube is shown as a two-piece structure having a power supply portion 14 and an atomizer/liquid reservoir portion 16 (also referred to herein as cartomizer). Together the power supply portion 14 and the atomizer/liquid reservoir portion 16 form a cylindrical tube which can be approximately the same size and shape as a conventional cigarette, typically about 100 mm with a 7.5 mm diameter, although lengths may range from 70 to 150 or 180 mm, and diameters from 5 to 28 mm.

The power supply portion 14 and atomizer/liquid reservoir portion 16 are typically made of metal (e.g., steel or aluminum, or of hardwearing plastic) and act together with the end cap 12 to provide a housing to contain the components of the e-cigarette 10. The power supply portion 14 and the atomizer/liquid reservoir portion 16 may be configured to fit together by, for example, a friction push fit, a snap fit, a bayonet attachment, a magnetic fit, or screw threads. The end cap 12 is provided at the front end of the power supply portion 14. The end cap 12 may be made from translucent plastic or other translucent material to allow a light-emitting diode (LED) 18 positioned near the end cap to emit light through the end cap. Alternatively, the end cap may be made of metal or other materials that do not allow light to pass.

An air inlet may be provided in the end cap, at the edge of the inlet next to the cylindrical hollow tube, anywhere along the length of the cylindrical hollow tube, or at the connection of the power supply portion 14 and the atomizer/liquid reservoir portion 16. FIG. 1 shows a pair of air inlets 20 provided at the intersection between the power supply portion 14 and the atomizer/liquid reservoir portion 16.

A power supply, preferably a battery 22, the LED 18, control electronics 24 and, optionally, an airflow sensor 26 are provided within the cylindrical hollow tube power supply portion 14. The battery 22 is electrically connected to the control electronics 24, which are electrically connected to the LED 18 and the airflow sensor 26. In this example, the LED 18 is at the front end of the power supply portion 14, adjacent to the end cap 12; and the control electronics 24 and airflow sensor 26 are provided in the central cavity at the other end of the battery 22 adjacent the atomizer/liquid reservoir portion 16.

The airflow sensor 26 acts as a puff detector, detecting a user puffing or sucking on the atomizer/liquid reservoir portion 16 of the e-cigarette 10. The airflow sensor 26 can be any suitable sensor for detecting changes in airflow or air pressure, such as a microphone switch including a deformable membrane which is caused to move by variations in air pressure. Alternatively, the sensor may be, for example, a Hall element or an electro-mechanical sensor.

The control electronics 24 are also connected to an atomizer 28. In the example shown, the atomizer 28 includes a heating coil 30 which is wrapped around a wick 32 extending across a central passage 34 of the atomizer/liquid reservoir portion 16. The central passage 34 may, for example, be defined by one or more walls of the liquid reservoir and/or one or more walls of the atomizer/liquid reservoir portion 16 of the e cigarette 10. The coil 30 may be positioned anywhere in the atomizer 28 and may be transverse or parallel to a longitudinal axis of a cylindrical liquid reservoir 36. The wick 32 and heating coil 30 do not completely block the central passage 34. Rather an air gap is provided on either side of the heating coil 30 enabling air to flow past the heating coil 30 and the wick 32. The atomizer may alternatively use other forms of heating elements, such as ceramic heaters, or fiber or mesh material heaters. Nonresistance heating elements such as sonic, piezo, and jet spray may also be used in the atomizer in place of the heating coil.

The central passage 34 is surrounded by the cylindrical liquid reservoir 36 with the ends of the wick 32 abutting or extending into the liquid reservoir 36. The wick 32 may be a porous material such as a bundle of fiberglass fibers or cotton or bamboo yarn, with liquid in the liquid reservoir 36 drawn by capillary action from the ends of the wick 32 towards the central portion of the wick 32 encircled by the heating coil 30.

The liquid reservoir 36 may alternatively include wadding (not shown in FIG. 1) soaked in liquid which encircles the central passage 34 with the ends of the wick 32 abutting the wadding. In other embodiments, the liquid reservoir may comprise a toroidal cavity arranged to be filled with liquid and with the ends of the wick 32 extending into the toroidal cavity.

An air inhalation port 38 is provided at the back end of the atomizer/liquid reservoir portion 16 remote from the end cap 12. The inhalation port 38 may be formed from the cylindrical hollow tube atomizer/liquid reservoir portion 16 or may be formed in an end cap.

In use, a user sucks on the e-cigarette 10. This causes air to be drawn into the e cigarette 10 via one or more air inlets, such as air inlets 20, and to be drawn through the central passage 34 towards the air inhalation port 38. The change in air pressure which arises is detected by the airflow sensor 26, which generates an electrical signal that is passed to the control electronics 24. In response to the signal, the control electronics 24 activate the heating coil 30, which causes liquid present in the wick 32 to be vaporized creating an aerosol (which may comprise gaseous and liquid components) within the central passage 34. As the user continues to suck on the e-cigarette 10, this aerosol is drawn through the central passage 34 and inhaled by the user. At the same time, the control electronics 24 also activate the LED 18 causing the LED 18 to light up, which is visible via the translucent end cap 12. Activation of the LED may mimic the appearance of a glowing ember at the end of a conventional cigarette. As liquid present in the wick 32 is converted into an aerosol, more liquid is drawn into the wick 32 from the liquid reservoir 36 by capillary action and thus is available to be converted into an aerosol through subsequent activation of the heating coil 30.

Some e-cigarette are intended to be disposable and the electric power in the battery 22 is intended to be sufficient to vaporize the liquid contained within the liquid reservoir 36, after which the e-cigarette 10 is thrown away. In other embodiments, the battery 22 is rechargeable and the liquid reservoir 36 is refillable. In the cases where the liquid reservoir 36 is a toroidal cavity, this may be achieved by refilling the liquid reservoir 36 via a refill port (not shown in FIG. 1). In other embodiments, the atomizer/liquid reservoir portion 16 of the e cigarette 10 is detachable from the power supply portion 14 and a new atomizer/liquid reservoir portion 16 can be fitted with a new liquid reservoir 36 thereby replenishing the supply of liquid. In some cases, replacing the liquid reservoir 36 may involve replacement of the heating coil 30 and the wick 32 along with the replacement of the liquid reservoir 36. A replaceable unit comprising the atomizer 28 and the liquid reservoir 36 may be referred to as a cartomizer.

The new liquid reservoir may be in the form of a cartridge (not shown in FIG. 1) defining a passage (or multiple passages) through which a user inhales aerosol. In other embodiments, the aerosol may flow around the exterior of the cartridge to the air inhalation port 38.

Of course, in addition to the above description of the structure and function of a typical e cigarette 10, variations also exist. For example, the LED 18 may be omitted. The airflow sensor 26 may be placed, for example, adjacent to the end cap 12 rather than in the middle of the e-cigarette. The airflow sensor 26 may be replaced by, or supplemented with, a switch which enables a user to activate the e cigarette manually rather than in response to the detection of a change in airflow or air pressure.

Different types of atomizers may be used. Thus, for example, the atomizer may have a heating coil in a cavity in the interior of a porous body soaked in liquid. In this design, aerosol is generated by evaporating the liquid within the porous body either by activation of the coil heating the porous body or alternatively by the heated air passing over or through the porous body. Alternatively the atomizer may use a piezoelectric atomizer to create an aerosol either in combination or in the absence of a heater.

Figure 2A:
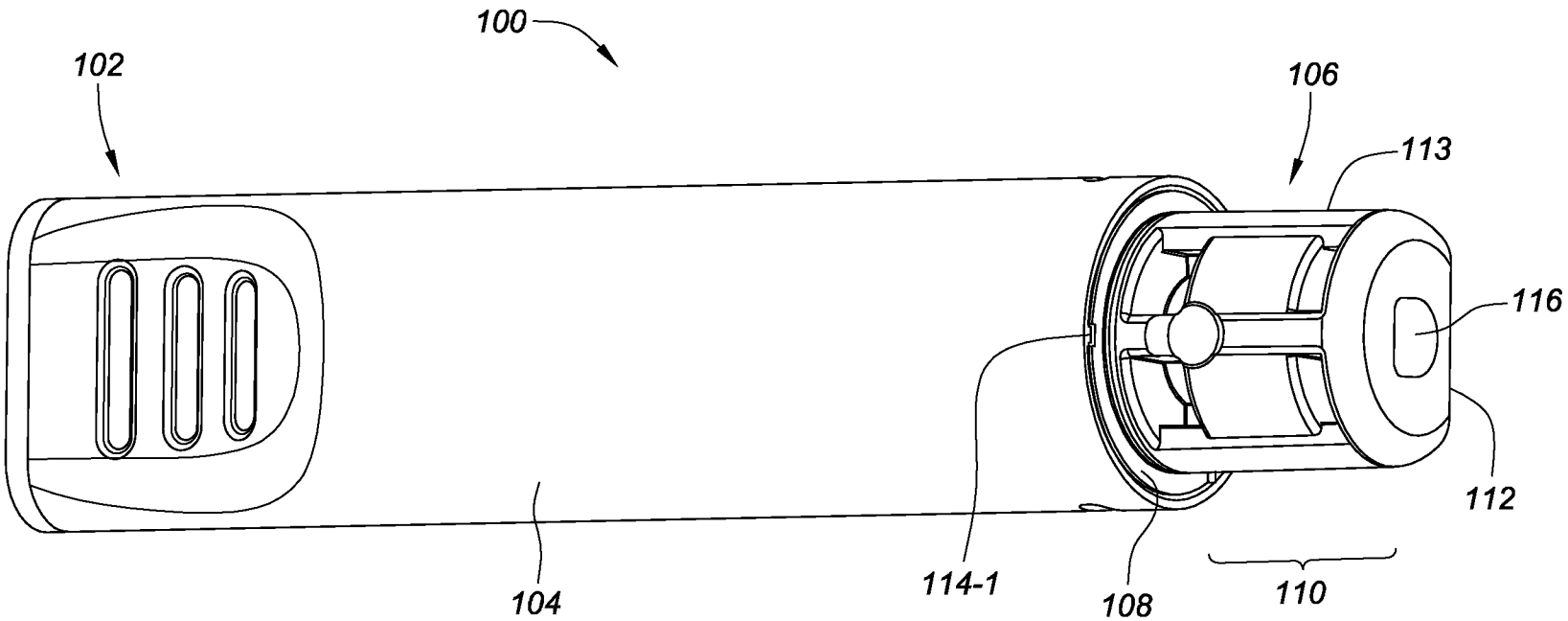
FIG. 2A is an isometric side, bottom, and distal end view of a cartomizer of an exemplary e-cigarette.

FIG. 2A is an isometric side, bottom, and distal end view of a cartomizer 100 of an exemplary e-cigarette. In an example, the cartomizer 100 can be connected with a power supply portion (e.g., battery) to provide power for an atomizer contained within the cartomizer 100. The cartomizer 100 can include a mouth piece portion 102 with one or more outlets (not shown), which can be configured for delivery of a vapor to a user.

The cartomizer 100 can include an outer tube 104 that is connected with the mouth piece portion 102. In an example, the mouth piece portion 102 can be connected with the outer tube 104 by press-fitting the mouth piece portion 102 into the outer tube 104 and/or through use of an adhesive applied between the outer tube 104 and the mouth piece portion 102, although other connecting technologies may be used. In some embodiments, the mouth piece portion 102, as well as other components of the cartomizer 100, can be connected with the outer tube 104 via a snap connecter, for example. In some embodiments, the mouth piece portion 102 and the outer tube 104 can be formed from a unitary piece of material.

The cartomizer 100 can include a battery connector 106 (e.g., a frictionally-engaged connector or other type of connector) that is configured to connect with (e.g., can be inserted into) a complementary connector comprising part of or associated with a housing for a power supply that is capable of providing power to an atomizer comprising part of the cartomizer 100; processing resources capable of executing instructions stored on a memory associated with the cartomizer 100; and/or memory. In an example, the battery connector 106 can be connected with the outer tube 104 by press-fitting the battery connector 106 into the outer tube 104. The battery connector 106 can include a tube mounting portion 108, a contact portion 110, and a coupling portion 111 (shown in FIG. 2B).

In some embodiments, the tube mounting portion 108 can have a diameter that is greater than, the same, or less than an inner diameter of the outer tube 104 and can be inserted into a distal end of the outer tube 104. The tube mounting portion 108 can include one or more alignment features 114-1 (114-2 is depicted in FIG. 2F), in some embodiments, that extend along a longitudinal portion of the tube mounting portion 108. In some embodiments, first and second alignment features 114-1, 114-2 can include a longitudinally extending groove and/or tongue that extends along the longitudinal portion of the tube mounting portion 108. In some embodiments, the inner surface of the outer tube 104 can include a complementary alignment feature. For example, where the tube mounting portion 108 includes a groove, the inner surface of the outer tube 104 can include a tongue that is configured to fit into the groove. In some embodiments, the battery connector 106 can define an air inlet 116, which comprises an axial cylindrical opening, which can pass through the battery connector 106 along a longitudinal axis of the battery connector 106.

Figure 2B:
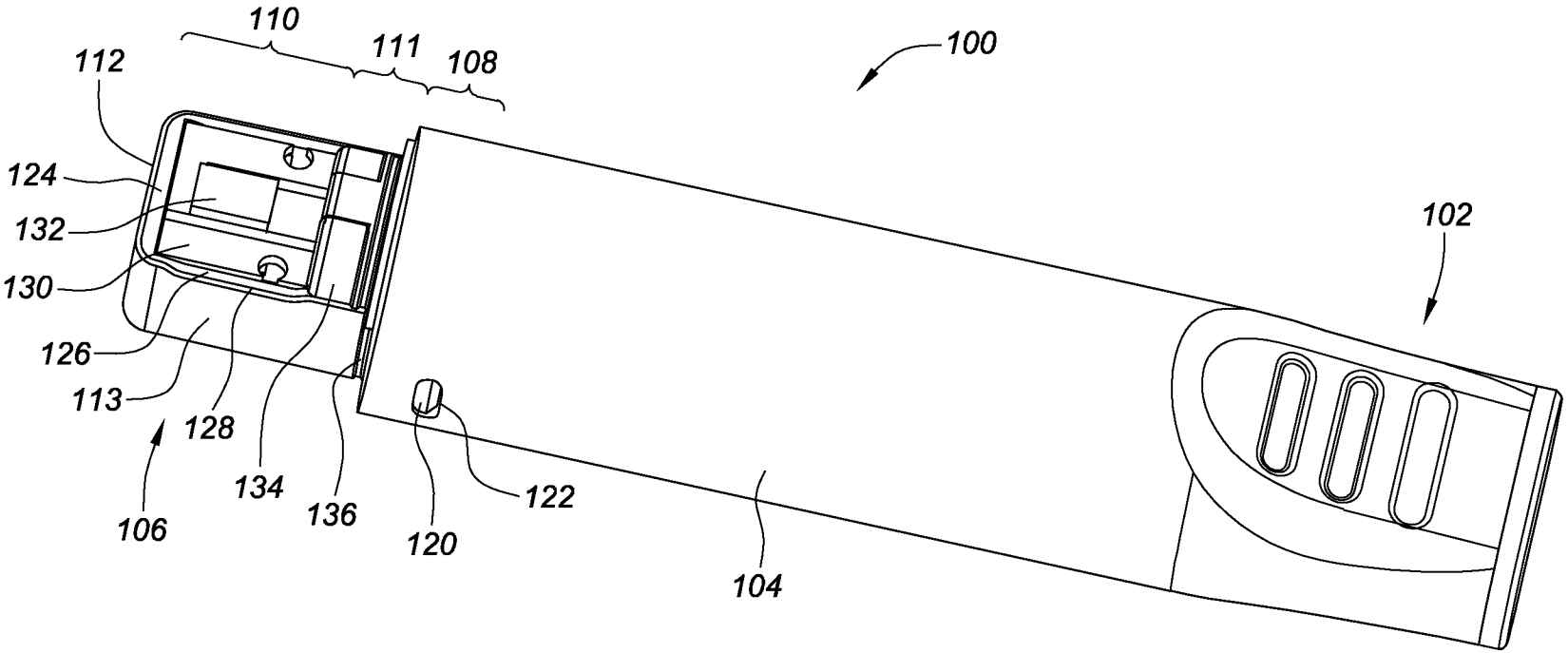
FIG. 2B is an isometric side and top view of the cartomizer depicted in FIG. 2A.

FIG. 2B is an isometric side and top view of the cartomizer depicted in FIG. 2A. The battery connector 106 can include a base connector 113 and a press-fit connector portion 134. The base connector 113 can be a horizontal cylindrical segment, which in some embodiments can be hemi-cylindrical in shape. The base connector 113 can include a contact portion 110 on a distal end of the base connector 113. The contact portion 110 can be a horizontal cylindrical segment, which in some embodiments can be hemi-cylindrical. The contact portion 110 can have an alignment feature 112, which can ensure that the contact portion 110 of the battery connector 106 is inserted with a correct orientation into the complementary connector that comprises the part of the housing for the power supply. The alignment feature 112 can include a flattened circumferential surface 124 of the horizontal cylindrical segment, which forms contact portion 110, in some embodiments. The flattened circumferential surface 124 can provide a mounting location for power, data connections and/or a memory, in some embodiments, as discussed further herein.

In some embodiments, the tube mounting portion 108 and the outer tube 104 can include complementary connectors. In an example, the tube mounting portion 108 can include a radially extending projection 120. In some embodiments, the radially extending projection 120 can be cylindrical and can extend from an outer surface of the tube mounting portion 108 transverse to a longitudinal axis of the battery connector 106. In some embodiments, the radially extending projection 120 can have a cross-section defined parallel to the longitudinal axis of the battery connector 106 that is circular, an ellipse, square, rectangular, etc.

The outer tube 104 can define a complementary connecter lumen 122 into which the radially extending projection can be inserted. For example, the outer tube 104 can define a hole formed with a shape that is complementary to the radially extending projection 120. For instance, the hole can extend through a wall of the outer tube 104 and can have a shape that is circular, an ellipse, square, rectangular, etc. In some embodiments, as previously discussed, the tube mounting portion 108 can have a diameter that is greater than, equal to, or less than an inner diameter of the distal end of the outer tube 104. In some embodiments where the tube mounting portion 108 has a diameter that is greater than the inner diameter of the distal end of the outer tube 104, upon insertion of the tube mounting portion 108 into the distal end of the outer tube 104, the distal end of the outer tube 104 can expand to accommodate the larger diameter tube mounting portion 108. This can provide for a secure fit between the battery connector 106 and the outer tube 104.

In some embodiments, the radially extending projection 120 can extend from the outer surface of the tube mounting portion 108. As the tube mounting portion 108 is inserted into the outer tube 104, the tube mounting portion 108 located adjacent to the radially extending projection 120 can deflect inward toward the longitudinal axis of the battery connector 106; and/or a portion of the outer tube 104 located adjacent to the complementary connector lumen 122 can deflect outward with respect to a longitudinal axis of the outer tube 104. When the radially extending projection 120 has been aligned with the complementary connector lumen 122, the tube mounting portion 108 and/or the outer tube 104 can deflect back to a natural state, causing the radially extending projection 120 to be disposed in the complementary connector lumen 122.

In some embodiments, a proximal face of the radially extending projection 120 can be angled and/or radiused to prevent interference between the proximal face of the radially extending projection 120 and a distal face of the outer tube 104. In some embodiments, a distal face of the radially extending projection 120 can be transverse to the longitudinal axis of the battery connector 106 to cause an interference fit between the distal face of the radially extending projection 120 and a distal side of the complementary connector lumen 122; thus preventing the battery connector 106 from being pulled apart from the outer tube 104.

As previously discussed, the battery connector 106 can include an alignment feature 112. The alignment feature 112 can include a flattened circumferential surface 124, which can be planar and parallel to a longitudinal axis of the battery connector 106. As further discussed herein, a cross-sectional profile of the contact portion 110 transverse to a longitudinal axis of the battery connector 106 can be D-shaped. In some embodiments, the flattened circumferential surface 124 can include a circuit depression 126, formed in an outer surface of the flattened circumferential surface 124. In some embodiments, the circuit depression 126 can be defined by a lip 128 extending around a portion of a perimeter of the flattened circumferential surface 124, which is further discussed herein.

The contact portion 110 can include a connection pad 130, which can be connected to the contact portion 110. The connection pad 130 can be disposed in the circuit depression 126 of the flattened circumferential surface 124. The connection pad 130 can include an electrical connection, which can serve to provide power to an atomizer and/or other features included in the cartomizer 100 that may require power to operate, and a data connection, which can serve to provide a communication link with various features of the cartomizer. In some embodiments, a memory 132 (e.g., physical memory) can be in communication with the data connection portion of the connection pad 130. The memory 132 can store parameters associated with the atomizer, in some embodiments.

In some embodiments, the battery connector 106 can include a press-fit connector 134. The press-fit connector 134 can include a complementary surface to the flattened circumferential surface 124 of the base connector 113. In an example, the press-fit connector 134 can be a horizontal cylindrical segment that can include a flattened circumferential surface, which can be complementary to the flattened circumferential surface of the base connector 113 (e.g., both surfaces can be planar). In some embodiments, the press-fit connector 134 can be connected with the base connector 113, such that the flattened circumferential surfaces of the base connector 113 and the press-fit connector 134 can be opposed to one another. The base connector 113 and the press-fit connector 134 can together form the coupling portion 111 and the tube mounting portion 108.

In some embodiments, the base connector 113 and the press-fit connector 134 can define a circumferential groove 136 around the coupling portion 111. In some embodiments, the complementary connector comprising part of or associated with a housing for a power supply 14 can include a circumferential ridge that radially extends from an inner surface of complementary connector and is configured to fit into the circumferential groove 136. In some embodiments, the circumferential ridge and the coupling portion 111 can fit together to provide a frictional fit between the housing for the power supply 14 and the coupling portion 111.

Figure 2C:
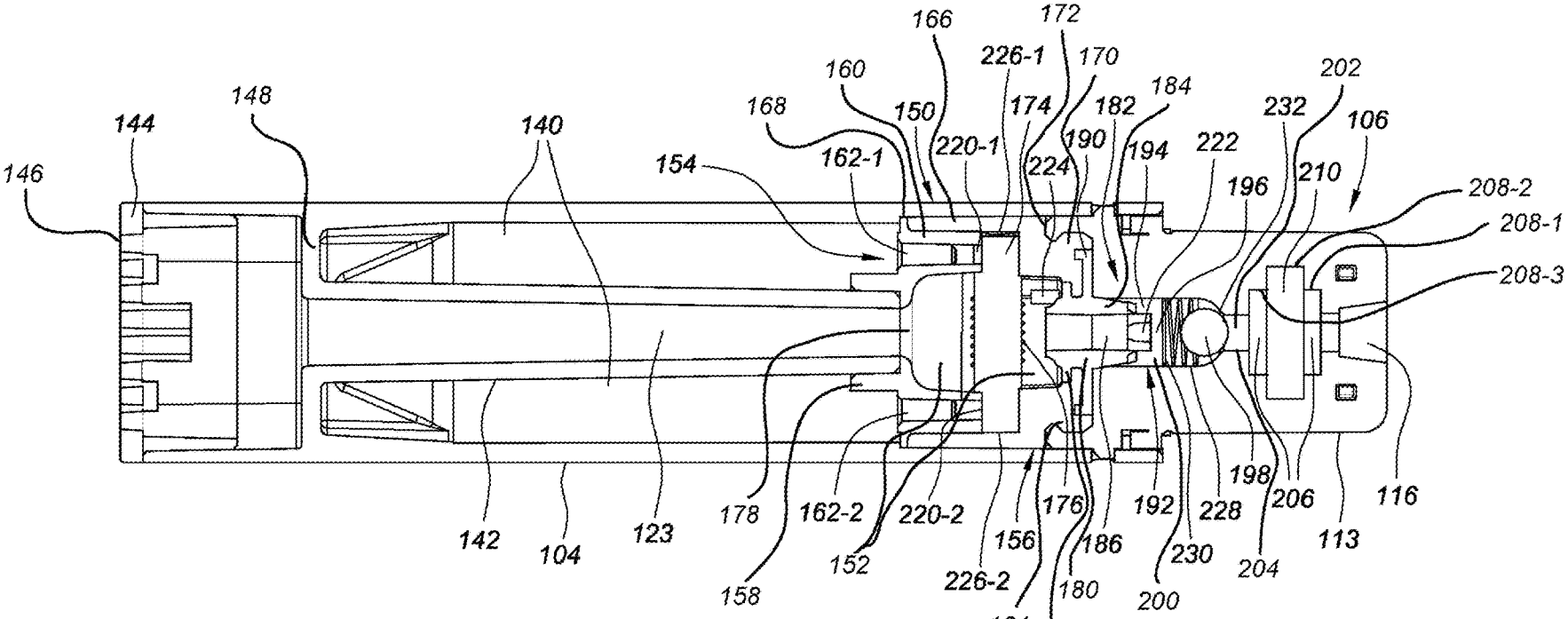
FIG. 2C is a cross-sectional view of the cartomizer depicted in FIG. 2A, which further depicts a backflow mitigation valve.

FIG. 2C is a cross-sectional side, bottom, and distal end view of the cartomizer depicted in FIG. 2A. The cartomizer 100 can include an annular liquid storage tank 140 that can be configured to hold liquid. In an example, the liquid can be vaporized by an atomizer and inhaled by a user. The liquid can include a flavoring and/or nicotine to enhance a user's experience. The annular liquid storage tank 140 can be annular in shape and can be defined by an outer surface of an inner tube 142 and an inner surface of an outer tube 104, which can be mounted around at least a portion of the inner tube 142. In some embodiments, the inner tube 142 and/or the outer tube 104 can be annular in shape. The inner tube 142 and the outer tube 104 can be connected with a mouth piece 144, in some embodiments. As such, vapor can travel through an air path 123 defined by an inner surface of the inner tube 142 and through a mouth piece passageway 146 formed in the mouth piece 144. In addition, by connecting the outer tube 104 to the mouth piece 144, a proximal end of the annular liquid storage tank 140 can be sealed by a connection between the outer tube 104 and the mouth piece 144 and a connection between the inner tube 142 and the mouth piece 144 and/or a proximal seal 148.

As depicted, in some embodiments, the proximal seal 148 can be placed between the inner tube 142 and the mouth piece 144, as illustrated in FIG. 2C. For instance, the proximal seal 148 can radially extend from a proximal end of the inner tube 142. In an example, the proximal seal 148 can have an outer surface that connects with an inner surface of the outer tube 104 and can have an inner surface that connects with an outer surface of the inner tube 142, thus sealing the proximal end of the annular liquid storage tank 140.

In some embodiments, a distal end of the inner tube 142 can be connected with a heater coil enclosure 150 (e.g. heater enclosure), which defines a heater coil chamber 152. The heater coil enclosure 150 can be formed from a heater coil housing 154 and a heater coil support 156. The heater coil housing 154 can include a proximally extending housing neck portion 158 of a first diameter and a distally extending housing base portion 160 of a second diameter, which is greater than the first diameter. The housing neck portion 158 can have an inner diameter that is less than an inner diameter of the base portion, which forms a proximal portion of the heater coil chamber 152.

In some embodiments, the distal end of the inner tube 142 can be connected to the housing neck portion 158 of the heater coil housing 154. As depicted, an outer circumferential surface of the distal end of the inner tube 142 can be connected with an inner circumferential surface of the housing neck portion 158. However, although not depicted, in some embodiments, the outer circumferential surface of the housing neck portion 158 can be connected with an inner circumferential surface of the inner tube 142. In some embodiments, an interface between the distal end of the inner tube 142 and the heater coil housing 154 can form a chamber air outlet 178.

The housing base portion 160 can include a flared proximal lip 168, in some embodiments. An outer circumference of flared proximal lip 168 can be connected with an inner wall of the outer tube 104, in some embodiments, which can form a seal between the inner wall of the outer tube 104 and the outer circumferential surface of the flared proximal lip 168, thus preventing liquid from leaking out of the annular liquid storage tank 140.

The heater coil support 156 can be annular in shape and can include a support neck portion 164 and a support base portion 166. In some embodiments, an inner diameter of the support base portion 166 of the heater coil support 156 can be greater than an outer diameter of the housing base portion 160 of the heater coil housing 154. The support base portion 166 of the heater coil support 156 can be disposed around the housing base portion 160 of the heater coil housing 154 and connected with the housing base portion 160 of the heater coil housing 154. The heater coil housing 154 and the heater coil support 156 define the heater coil chamber 152 between the housing neck portion 158 of the heater coil housing 154 and a distal end of the support neck portion 164 of the heater coil support 156.

In some embodiments, a distal end of the heater coil support 156 can be connected to the proximal end of the battery connector 106. In an example, a distal outer circumferential surface of the support neck portion 164 can define a circumferential support groove 170. The circumferential support groove 170 can circumferentially extend around a portion of an outer surface of the support neck portion 164. The proximal end of the battery connector 106 can include a circumferential ridge 172 that circumferentially extends around an inner surface of the proximal end of the battery connector 106. In some embodiments, the battery connector 106 and the heater coil support 156 can be formed of a semi-rigid material, which can allow an inner diameter of the circumferential ridge 172 to expand and contract as the battery connector 106 and the heater coil support 156 are pushed together. In an assembled state, the circumferential ridge 172 can be disposed in the circumferential support groove 170.

In some embodiments, the heater coil enclosure 150 can house a wick 174. Either end of the wick 174 can be captured via complementary wick notches that form ports in the heater coil housing 154 and the heater coil support 156 (further depicted and described herein). The wick 174 can extend through a center of a heater coil 176, which in some embodiments can be circumferentially wrapped around the wick 174 and can be at least partially mounted within the heater coil enclosure 150.

In some embodiments, the heater coil housing 154 can define a first liquid lumen 162-1 and a second liquid lumen 162-2, configured to provide liquid from the annular liquid storage tank 140 to the wick 174. The first liquid lumen 162-1 can longitudinally extend through a first side of the heater coil housing 154 and the second liquid lumen 162-2 can longitudinally extend through a second side of the heater coil housing 154, diametrically opposed to the first liquid lumen 162-1. In some embodiments, the first liquid lumen 162-1 and the second liquid lumen 162-2 can be defined by the heater coil housing 154, such that the first liquid lumen 162-1 and the second liquid lumen 162-2 can pass through the heater coil housing 154 parallel to a longitudinal axis of the heater coil housing 154. The first liquid lumen 162-1 and the second liquid lumen 162-2 can provide liquid passageways from the annular liquid storage tank 140 to each end of the wick 174. For example, each liquid lumen 162-1, 162-2 can provide liquid to each end of the wick 174. Thus, liquid can absorb into the wick 174 from either end of the wick 174 and can be atomized by the heater coil 176.

In some embodiments, the distal end of the support neck portion 164 of the heater coil support 156 can define an inlet lumen 180. As depicted, the inlet lumen 180 can be circular. However, the distal end of the support neck portion 164 can define the inlet lumen 180 as other shapes, such as a square, triangle, oval, etc. In some embodiments, a valve grommet 182 can include an elongate body 184 that extends along a longitudinal axis. The elongate body 184 can define a lumen, which is referred to herein as a chamber air inlet 186. The proximal end of the elongate body 184 can include a proximal flange 188 and a distal flange 190.

The proximal flange 188 and the distal flange 190 can extend outwardly from the elongate body 184 and in some embodiments transverse to a longitudinal axis of the elongate body 184. The distal flange 190 can extend outwardly from the elongate body 184 and in some embodiments transverse to a longitudinal axis of the elongate body 184. In some embodiments, a diameter of the proximal flange 188 can be less than a diameter of the distal flange 190, which can allow for the proximal flange 188 to be pushed through the inlet lumen 180. For example, the valve grommet 182 can be formed from a flexible material (e.g., rubber) to allow for the proximal flange 188 to flex and be pushed through the inlet lumen 180.

In some embodiments, the distal end of the valve grommet 182 can include an airflow admitter 192. The airflow admitter 192 can be configured to allow for unrestricted airflow into the heater coil chamber 152 via the chamber air inlet 186. The airflow admitter 192 can work in combination with a valve ball 198, a valve chamber 200, and a valve opening 202 defined by the base connector 113 to allow for airflow to enter the heater coil chamber 152 but restrict an airflow out of the valve opening 202. For example, air can flow one way with respect to the cartomizer 100. While air can flow into the cartomizer 100, air or a minimal amount of air is allowed to flow out of the cartomizer 100.

In an example, the valve chamber 200 can be defined by walls of the base connector 113 and can have a diameter that is greater than a diameter of the valve ball 198 to allow an airflow to pass around the valve ball 198 in the valve chamber 200. In some embodiments, the valve ball 198 can be formed from metal and/or plastic. This can allow the valve ball 198 to move longitudinally in the valve chamber 200. The valve opening 202 can be defined by the base connector 113 and can be disposed at a distal end of the valve chamber 200. The valve opening 202 can have a smaller diameter than the valve chamber 200 and a smaller diameter than the valve ball 198.

As a user draws air through the mouth piece 144, air can enter through the valve opening 202 and can travel proximally through the valve chamber 200. As the airflow enters through the valve opening 202, the airflow can move the valve ball 198 from the valve opening 202. For example, the airflow can flow around the valve ball 198 and lift the valve ball 198 from the valve opening 202, thus allowing air to enter into the valve chamber 200. In some embodiments, the airflow admitter 192 can function to block the valve ball 198 from entering the chamber air inlet 186. For example, the airflow admitter 192 forms a cage over an entrance of the chamber air inlet 186, thus preventing the valve ball 198 from entering the chamber air inlet 186 and/or blocking an entrance of the chamber air inlet 186 (e.g., preventing an airflow from passing through the chamber air inlet 186).

As further depicted in FIG. 2C, the valve ball 198 can work in combination with a valve spring 228 to form a backflow mitigation valve. In an example, the valve spring 228 can be disposed proximally of the valve ball 198 and can provide a restorative force to the valve ball 198, causing the ball to be seated against a valve sealing surface 232 of the battery connector. In an example, when a user puffs on the mouth piece 144, air can be drawn into the air inlet 116. In an example, a negative pressure can be created within the airpath that is defined by the cartomizer. The negative pressure can cause the valve ball 198 to become unseated from the valve sealing surface 232 and travel proximally. As the valve ball 198 becomes unseated from the valve sealing surface 232, air can travel past the valve ball 198 and into the chamber air inlet 186. In some embodiments, without the valve spring 228, if the cartomizer is tipped to its side or in a way that causes the mouthpiece 144 to be placed lower than the battery connector 106, the valve ball 198 can become unseated from the sealing surface due to gravity. Accordingly, the valve spring 228 can provide a force to the valve ball 198, holding the valve ball 198 in place when the cartomizer is tipped. Additionally, the valve spring 228 can exert pressure against the valve ball, causing a more robust seal to be created between the valve ball and the sealing surface 232.

In some embodiments, a spring retainer 230 can be disposed proximally of the valve spring 228 and the valve ball 198. The spring retainer 230 can limit movement of a proximal end of the valve spring 228. For example, by limiting the proximal movement of the valve spring 228, the valve spring 228 can be compressed when the valve ball 198 is moved proximally due to the incoming air flow through the air inlet 116. When the air flow decreases and/or stops, the valve ball 198 can be returned to its seated position against the valve sealing surface 232 via the force exerted by the valve spring 228.

In some embodiments, in lieu of a spring, an electromagnet can be used to hold the valve ball 198 in place. In an example, a switch can be included in the electronic cigarette that detects when a user is drawing air into the electronic cigarette. For example, a pressure sensitive switch and/or an air flow detection switch can be activated, which can deactivate the electromagnet (e.g., energized coil) and release the valve ball 198, allowing air to flow through the one-way ball valve. When an air flow through the one-way ball valve stops, the electromagnet can be reactivated, capturing the ball valve and preventing air from flowing through the one-way ball valve.

In some embodiments, the airflow admitter 192 can comprise one or more longitudinally extending arms (e.g., longitudinally extending arm 194) that encircle a distal opening of the chamber air inlet 186. For example, the one or more longitudinally extending arms can be disposed on a distal end of the valve grommet 182 about the chamber air inlet 186. Although the cross-sectional view depicted in FIG. 2C depicts two longitudinally extending arms 194, the airflow admitter 192 can include more than or less than two longitudinally extending arms 194. For example, as further discussed herein, the airflow admitter 192 can include three longitudinally extending arms 194. In some embodiments, the distal ends of the longitudinally extending arms 194 can be connected via an arm connector 196. The arm connector 196 can connect each one of the longitudinally extending arms 194 together, in some embodiments.

In some embodiments, the walls of the base connector 113 that define the valve chamber 200 can be radiused toward the valve opening 202 at a distal end of the valve chamber 200 to form a radiused wall 204 that circumferentially extends around the proximal side of the valve opening 202. The radiused wall 204 can help to create a seal with the valve ball 198. Accordingly, as air flows into the valve chamber 200 from the chamber air inlet (e.g., as a result of a user blowing on the mouth piece 144), the valve ball 198 can be cradled by the radiused wall 204, creating a seal and preventing air from flowing through the valve opening 202.

In some embodiments, the base connector 113 can define an air inlet chamber 206. The air inlet chamber 206 can be defined by an inner wall of the base connector 113. In some embodiments, the air inlet chamber 206 can be a cylindrical chamber that extends along a longitudinal axis of the base connector 113. In some embodiments, the air inlet chamber 206 can be defined by the inner wall of the base connector 113, which comprises a first inner wall 208-1 with a first diameter, a second inner wall 208-2 with a second diameter, and a third inner wall 208-3 with a second diameter. As depicted, the first diameter can be less than the second diameter and equal to the third diameter. The second inner wall 208-2 with the second diameter can form a slot in which a porous material 210 (e.g., absorbent material) can be placed, as depicted in FIG. 2C.

The porous material 210 can be formed of an absorbent material, in some embodiments. The porous material 210 can prevent liquid from traveling from the portion of the air inlet chamber defined by the third inner wall 208-3 from leaking into the portion of the air inlet chamber defined by the first inner wall 208-1; and thus preventing liquid from leaking out of the air inlet 116, as further discussed herein. In some embodiments, the porous material 210 can include hydrophobic properties. In some embodiments, the porous material 210 can include oleophobic properties. For example, the porous material 210 can include a hydrophobic and/or oleophobic coating. In some embodiments, the properties of the porous material 210 can be configured to repel moisture created by a user's breath passing into the cartomizer from the mouth piece 144 and/or repel liquid that has dripped from the wick 174 and/or condensed from vapor in the heater coil chamber 152.

The base connector 113 can include an alignment feature 112, in some embodiments. The base connector 113 can define the air inlet 116, which can be defined by a cylindrical wall that extends through a distal face of the base connector 113, along a longitudinal axis of the base connector 113. In some embodiments, the air inlet 116 can be frustoconical. For example, a diameter of the air inlet 116 can decrease from a distal end of the air inlet 116, proximally along the length of the air inlet 116. This can cause a velocity of air passing through the air inlet 116 to be increased, thus providing a higher velocity airflow, which can improve atomization of the liquid.

In some embodiments, the cartomizer can be connected to the power supply portion 14 (FIG. 1), which can include control electronics, as well as an airflow sensor 26 (FIG. 1). The electronics and the airflow sensor 26 can be susceptible to moisture, in some embodiments. Accordingly, embodiments of the present disclosure can prevent moisture from contacting the control electronics, airflow sensor 26, and/or other components housed in the power supply portion 14. For example, one cause of moisture contacting the components in the power supply portion 14 can be a user blowing into the cartomizer 100 via the mouth piece 144. Blowing into the cartomizer 100 can cause moisture from a user's breath to condense in the cartomizer 100, potentially causing droplets of water to coalesce. Alternatively, or in addition, the user's breath can carry with it liquid that has dripped from the wick 174. This condensation and/or liquid from the wick 174 can travel distally down the cartomizer 100 along with the user's breath and could potentially exit air inlet 116 of the cartomizer 100, causing condensation/liquid to enter the power supply portion 14. Embodiments of the present disclosure can prevent this phenomenon from occurring. For example, as a user blows into the mouth piece 144, the valve ball 198 can be positioned over the valve opening 202, which can prevent air from traveling through the cartomizer 100 and out of the air inlet 116. As a result, moisture is also prevented from traveling through the cartomizer 100 and out of the air inlet 116. In addition, if the cartomizer is held vertically, gravity can cause the valve ball 198 to be positioned over the valve opening 202, preventing moisture from exiting the valve opening 202 and entering into the air inlet chamber 206. However, even if moisture from the liquid and/or user's breath enters the air inlet chamber 206, the porous material 210 can absorb and retain the moisture, preventing it from exiting the air inlet 116.

In some embodiments, the porous material 210 can comprise hydrophobic and/or oleophobic properties, which can cause moisture to be repelled from the porous material 210, preventing the moisture from traveling from a proximal side of the porous material 210 to a distal side of the porous material 210 and out of the air inlet 116. This can cause moisture to remain in portions of the cartomizer 100 that are located proximally with respect to the porous material 210 (e.g., the portion of the air inlet chamber 206 defined by the third inner wall 208-3). The airflow admitter 192, valve chamber 200, valve ball 198, and valve opening 202 can function as a one way valve. However, other types of one way valves can be utilized with various embodiments of the present disclosure. For example, a one way valve can be disposed in the inlet lumen 180 and/or distally with respect to the inlet lumen 180 to provide for a one way flow of air.

Accordingly, as a user sucks on the mouth piece 144, air can be drawn into the air inlet 116 and into a portion of the air inlet chamber 206 formed by the first inner wall 208-1. The air can be drawn across the porous material 210 and into the portion of the air inlet chamber formed by the third inner wall 208-3. The air can continue through the valve opening 202 and into the valve chamber 200. If the valve ball 198 was seated in the proximal side of the valve opening 202, the force of the airflow moving past the valve ball 198 can lift the valve ball 198 proximally from its seated position, allowing air to freely flow through the valve opening 202, into the valve chamber. As the valve ball 198 is lifted proximally from its seated position, the airflow admitter 192 of the valve grommet 182 can prevent the valve ball 198 from being lodged in an opening of the chamber air inlet 186. Thus, air can flow around the longitudinally extending arm(s) 194 and into the chamber air inlet 186 and into the heater coil chamber 152.

Air being drawn into the air inlet 116 as a result of the user sucking on the mouth piece 144 can cause air to be drawn across the airflow sensor, which can be housed in the power supply portion 14. A computer executable instruction can be executed by a processor in communication with the airflow sensor, causing the heater coil 176 to be activated. The air can flow across the wick 174 and heater coil 176, bringing with it vapor that has been generated by the atomization of liquid, which can be atomized via the heater coil 176 and wick 174. The vapor can be carried through the chamber air outlet 178 and into the air path 123 defined by the inner surface of the inner tube 142 and through a mouth piece passageway 146 formed in the mouth piece 144. Liquid can flow from the annular liquid storage tank 140 and through the first and second liquid lumens 162-1, 162-2. The liquid can contact the wick 174 at respective first and second liquid/wick interfaces 220-1, 220-2 between the wick 174 and the first and second liquid lumens 162-1, 162-2.

In some embodiments, the wick 174 can include a first end portion and a second end portion and can extend through a center of the heater coil 176. The first end portion can extend into a first wick bore 226-1 defined in a first wall of the heater coil enclosure 150 and the second end portion can extend into a second wick bore 226-2 defined in a second wall of the heater coil enclosure 150. In some embodiments, the first end portion of the wick 174 can be in fluid communication with the annular liquid storage tank 140 via a first liquid lumen 162-1 that extends through the first wall of the heater coil enclosure 150; and the second end portion of the wick 174 can be in fluid communication with the annular liquid storage tank 140 via a second liquid lumen 162-2 that extends through the second wall of the heater coil enclosure 150.

As previously discussed, the valve grommet 182 can include an airflow admitter 192. The airflow admitter 192 can be formed by a longitudinally extending arm(s) 194. The longitudinally extending arm(s) 194 can be equally spaced about a distal end of the flow admitter and around the chamber air inlet 186. The longitudinally extending arm(s) 194 can be connected at their distal ends via an arm connector 196. As such, the longitudinally extending arm(s) 194 in combination with the arm connector 196 can define an airflow admitter aperture 222 through which air can flow. As previously discussed, the airflow admitter 192 can prevent the valve ball 198 from blocking an entrance of the chamber air inlet 186. Although the airflow admitter 192 is depicted as being formed as a separate component, the airflow admitter 192 can be integrally formed with the support neck portion 164 of the heater coil support 156. In some embodiments, a screen can be disposed over a portion of the air path located proximally with respect to the valve ball 198, preventing the valve ball 198 from blocking the air path. Alternatively, a pin can be inserted across the air path located proximally with respect to the valve ball 198 to prevent the valve ball 198 from blocking the air path.

In some embodiments, the distal flange 190 of the valve grommet 182 can create a seal between the heater coil support 156 and the base connector 113. The airflow sensor, in some embodiments can be included in the power supply portion 14. The heater coil 176 can be controlled, based on measurements taken by the airflow sensor. For example, power can be provided from the power supply portion 14 via a coil power lead 224, based on the measurements taken by the airflow sensor. As such, it can be important that the same amount of airflow that is measured by the airflow sensor disposed in the power supply portion 14 is delivered to the wick 174 and heater coil 176. Accordingly, the distal flange 190 can create a seal between the heater coil support 156 and the base connector 113, preventing air from escaping from the joint between the heater coil support 156 and the base connector 113 and preventing air from entering from the joint between the heater coil support 156 and the base connector 113.

Figure 3:
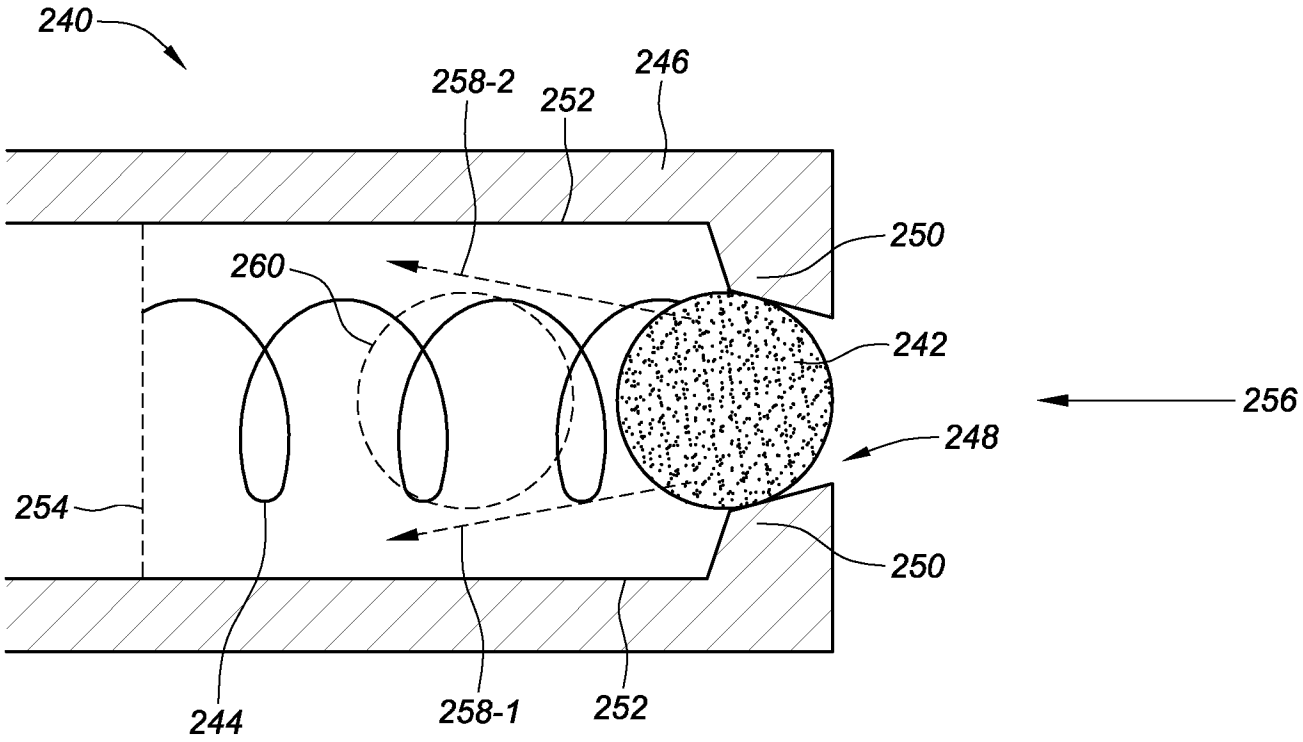
FIG. 3 is a cross-sectional side view of a backflow mitigation valve that includes a valve ball and valve spring.

FIG. 3 is a cross-sectional side view of a backflow mitigation valve assembly 240 that includes a valve ball 242 and valve spring 244, in accordance with embodiments of the present disclosure. In some embodiments, the valve ball 242 and the valve spring 244 can be contained in a holder portion 246. In an example, the holder portion 246 can be a battery connector of a cartomizer, as depicted in FIG. 2C. The holder portion 246 can define an air inlet 248, which can be defined by a distal end of the holder portion 246. In some embodiments, a shoulder portion 250 can extend radially inward from a distal end of the holder portion 246. In an example, the shoulder portion 250 can extend radially inward from an inner surface 252 of the holder portion 246. In some embodiments, the shoulder portion 250 can define an orifice (e.g., air inlet 248) with a decreased diameter in relation to the diameter of the lumen defined by the inner surface 252. In some embodiments, the diameter of an orifice defined by the shoulder portion 250 can be less than a diameter of the valve ball 242, which can prevent the valve ball from traveling through the orifice (e.g., air inlet 248). The proximal portion of the valve spring 244 can be retained by a spring retainer 254. In some embodiments, the spring retainer 254 can be a pin that extends across the lumen defined by the holder portion 246, which can prevent the proximal end of the valve spring 244 from traveling proximally. In some embodiments, the spring retainer 254 can be a shoulder portion much like the shoulder portion 250, which defines a reduced diameter orifice through which the valve spring 244 cannot fit and thus prevents the valve spring 244 from traveling proximally. In some embodiments, the spring retainer 254 can be a screen that extends across the lumen defined by the holder portion 246.

In an example, air traveling into the air inlet 248, along air path 256 can displace the valve ball 242, causing the valve ball 242 to move proximately, in a direction represented by arrows 258-1, 258-2. For instance, the valve ball 242 can move into a displaced position 260, represented in phantom, thus compressing the valve spring 244. When the air flow stops entering the air inlet 248, the force exerted by the valve spring 244 against the valve ball 242 can move the valve ball back into a position, such that it contacts the shoulder portions 250, thus creating a seal. As depicted in FIG. 3, gap can exist between the outer edges of the valve ball 242 and the inner surface 252, to enable air to pass along either side of the valve ball, when the valve ball has been unseated from the shoulder portion 250 by the air flow.

Figure 4A:
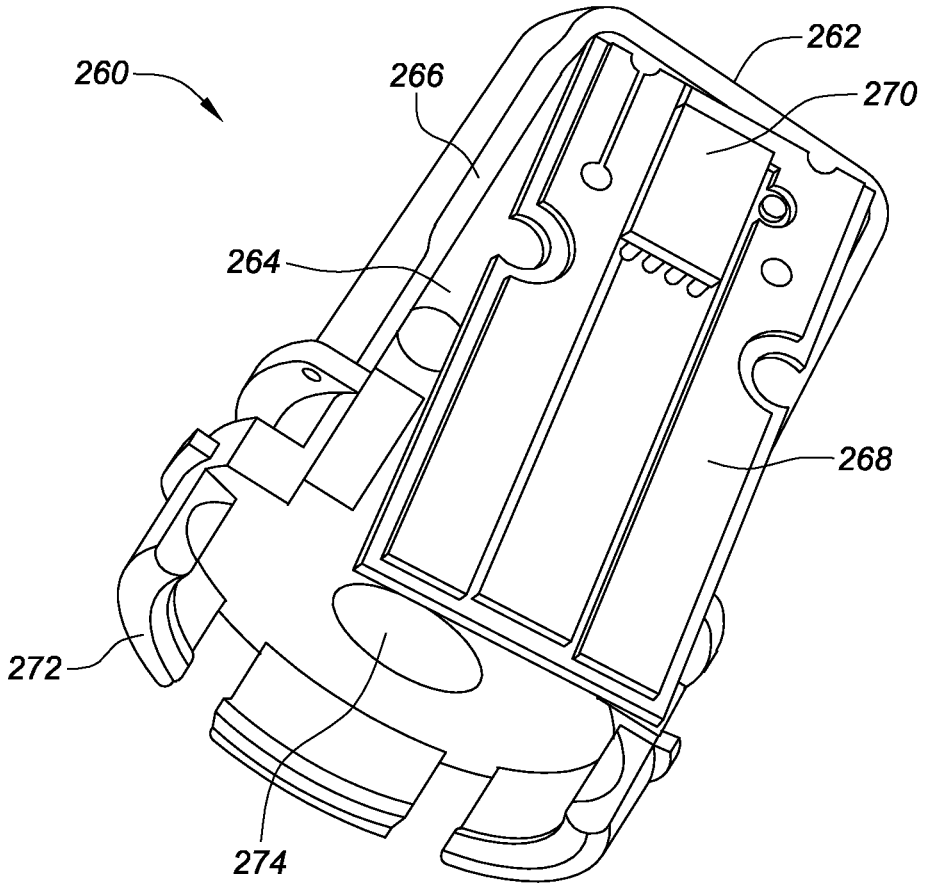
FIG. 4A is an isometric view of a battery connector with a connection pad.

FIG. 4A is an isometric view of a battery connector 260 with a connection pad 268, which can include the same or similar features as those discussed in relation to FIGS. 2A to 2C. In some embodiments, the battery connector 260 can include a flattened circumferential surface 262, which can include a circuit depression 264, formed in an outer surface of the flattened circumferential surface 262. In some embodiments, the circuit depression 264 can be defined by a lip 266 extending around a portion of a perimeter of the flattened circumferential surface 262, which is further discussed herein.

In some embodiments, the battery connector 260 can include a connection pad 268, which can be disposed in the circuit depression 264 of the flattened circumferential surface 262. The connection pad 268 can include an electrical connection, which can serve to provide power to an atomizer and/or other features included in a cartomizer that may require power to operate, and a data connection, which can serve to provide a communication link with various features of the cartomizer. In some embodiments, a memory 270 (e.g., physical memory) can be in communication with the data connection portion of the connection pad 268. The memory 270 can store parameters associated with the atomizer, in some embodiments.

In some embodiments, the battery connector 260 can include one or more connection fittings disposed on a proximal end of the battery connector 260. For example, one or more press fit connection fittings (e.g., connection fitting 272) can enable the battery connector 260 to be disposed on a distal end of an atomizer (e.g., cartomizer), enabling a lumen 274 defined by the battery connector 260 to be fluidly coupled with an air inlet lumen defined in the atomizer. In an example, air can enter the battery connector 260 via an air inlet, as previously discussed and can exit the battery connector 260 into the atomizer via the lumen 274.

In some embodiments, the connection pad 268 can be a planar substrate that includes one or more circuits formed on the connection pad 268, which electrically couple the memory to a processor. In some embodiments, the memory and a processor can both be included on the connection pad. For example, in some embodiments, the memory and the processor can both be included in the item labeled by the element number 270. The connection pad 268 can be disposed within a recessed area (e.g., circuit depression 264) of the battery connector defined by the lip 266.

Figure 4B:
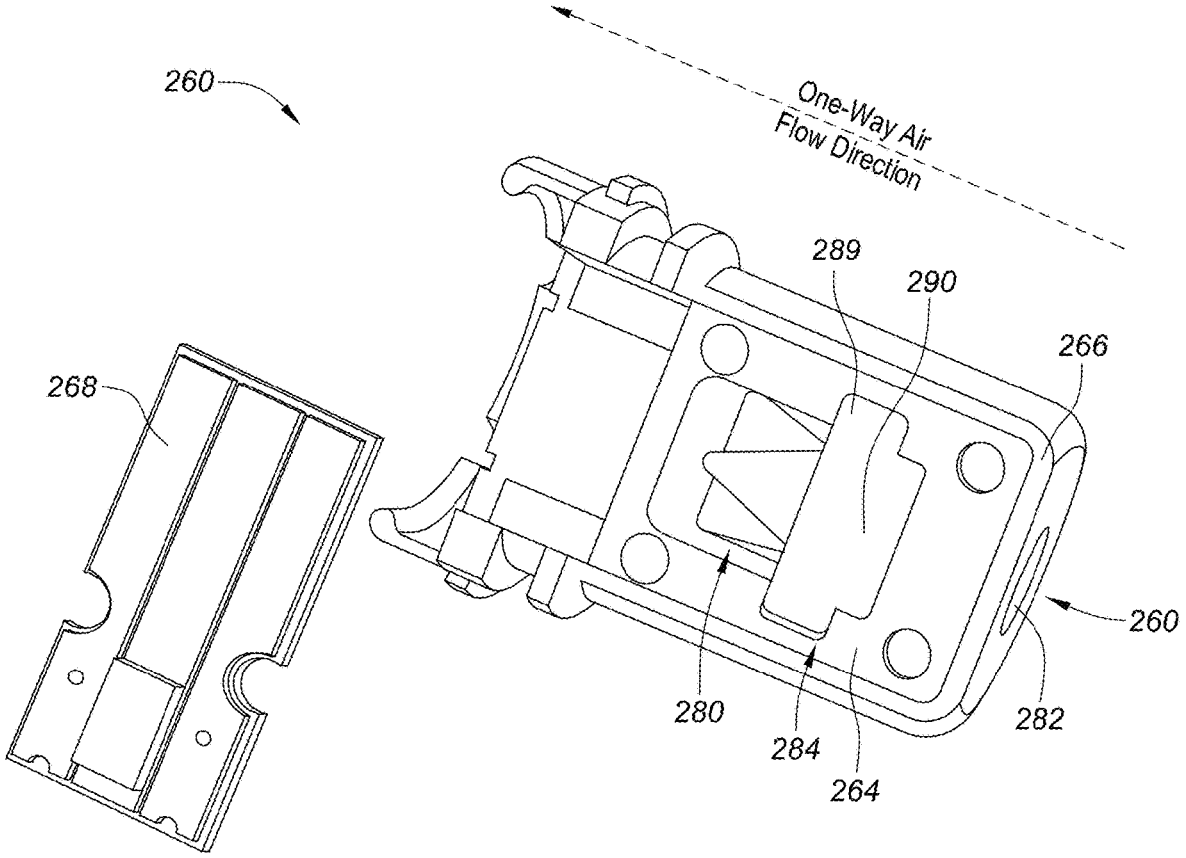
FIG. 4B is an isometric view of the battery connector of FIG. 4A, with the connection pad removed.
Figure 5A:
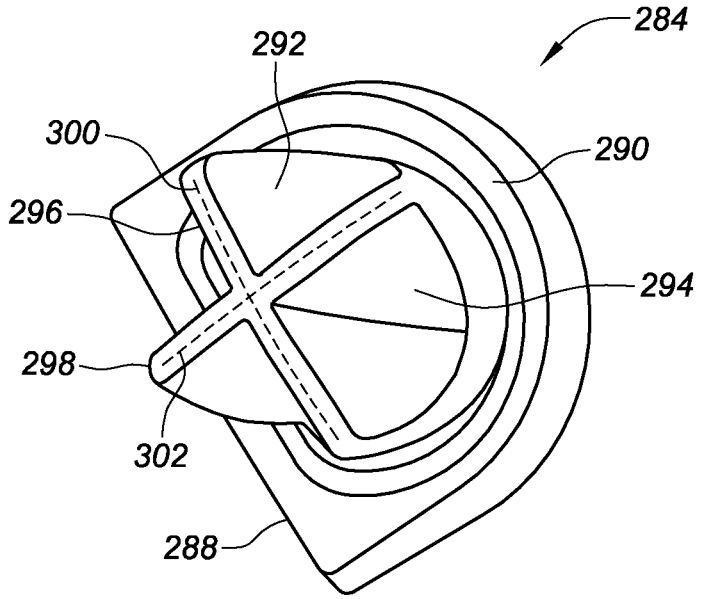
FIGS. 5A and 5B are isometric top views of a double duckbill valve.
Figure 5B:
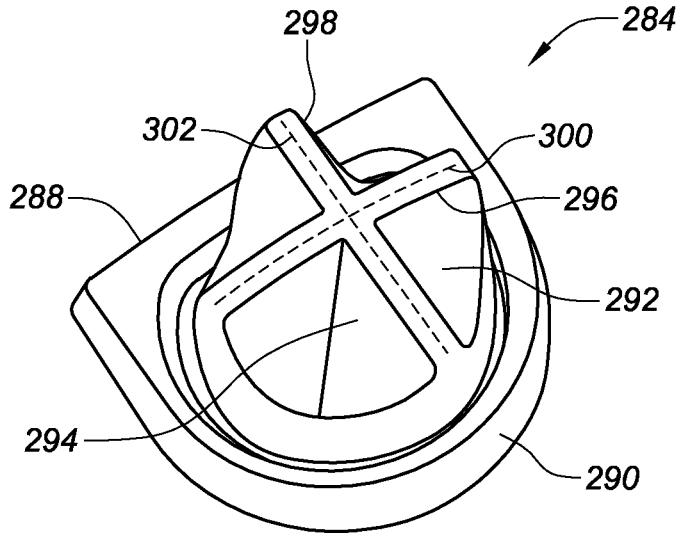
Figure 5C:
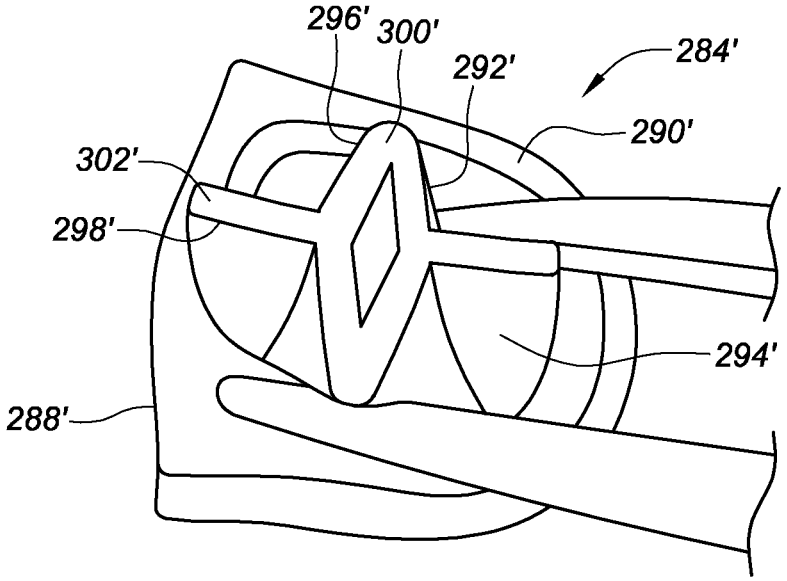
FIG. 5C is an isometric top view of the double duckbill valve depicted in FIGS. 5A and 5B in an open configuration.

FIG. 4B is an isometric view of the battery connector 260 of FIG. 4A, with the connection pad 268 removed. As depicted, the connection pad 268 has been removed from the circuit depression 264 defined by the lip 266. As depicted, a valve chamber 280 can be defined within the battery connector 260. The valve chamber 280 can be in fluid communication with an air inlet 282 and the lumen 274 (depicted in FIG. 4A). In some embodiments, a double duckbill valve 284 (e.g., one-way valve) can be disposed within the valve chamber 280. Although a double duckbill valve 284 is depicted, any type of one-way valve can be disposed in within the battery connector 260. The double duckbill valve 284 can allow for air to flow in a direction indicated by the one-way air flow directional arrow depicted in FIG. 4B. For example, air can flow into the air inlet and out of the lumen 274 (e.g., air outlet) and into a chamber air inlet 186, depicted in FIG. 2C. However, when air flow through the battery connector 260 in the direction of the one-way air flow directional arrow stops, the double duckbill valve 284 can seal, preventing air flow in a direction opposite to the one-way air flow directional arrow from occurring. As discussed, any type of one-way valve can be disposed within the valve chamber 280. FIGS. 5A to 5C further depict the double duckbill valve 284. FIGS. 4A to 13 represent different embodiments of one-way valves that can be disposed within the valve chamber 280. In some embodiments, the one-way valves discussed herein can be disposed proximally with respect to an atomizing chamber and/or distally with respect to the atomizing chamber. For example, a one-way valve can be disposed in a mouth piece, proximally of the atomizing chamber. In some embodiments, the one-way valve can be disposed distally with respect to the atomizing chamber, in a battery connector and/or battery portion of an electronic cigarette.

FIGS. 5A and 5B are isometric top views of a double duckbill valve 284, which can be included in an electronic cigarette to aid with one-way air flow through the electronic cigarette. In some embodiments, as depicted and discussed in FIGS. 4A and 4B, the double duckbill valve can be included in a battery connector 260 (FIGS. 4A and 4B). In some embodiments, the double duckbill valve can include a base portion 290. In some embodiments, the base portion 290 can have a thickness and/or durometer that is greater than other portions of the double duckbill valve 284, to provide a stable base for the valve portion of the double duckbill valve 284. As depicted in FIG. 4B, the base portion 290 can be flared such that it can be inserted into a shoulder portion 289 defined in the valve chamber 280 of the battery connector 260. In some embodiments, the base portion 290 can have a flattened side 288, which can be disposed next to the connection pad 268, as depicted in FIGS. 4A and 4B.

In some embodiments, the valve portion of the double duckbill valve 284 can include orthogonal duckbill valves that extend upwards from the base portion 290. Each one of the orthogonal duckbill valves can include a valve body 292, 294. The valve bodies can extend upwards (e.g., away from the page) and away from the base portion 290, in a proximal direction. A cross-sectional width of each one of the valve bodies 292, 294 can be reduced as the valve bodies extend upwards and away from the base portion 290. For example, the cross-sectional width of the valve bodies 292 (e.g., a width between opposite corresponding sides of the valve bodies 292, 294) can be decreased as the valve bodies 292, 294 extend away from the base portion 290. In some embodiments, the cross-sectional width of the valve bodies 292, 294 can decrease from the base portion 290 to the corresponding valve lips 296, 298 of each valve body 292, 294. In some embodiments, the valve lips 296, 298 can define slits 300, 302 defined in proximal faces of each one of the valve bodies 292, 294. In an example, as air flows through the double duckbill valve from the distal end out of the proximal end, the slits 300, 302 can open and air can pass out of the proximal end of the double duckbill valve.

FIG. 5C further depicts the double duckbill valve 284' of FIGS. 5A and 5B in an open configuration, which allows an air flow to pass from a distal end through the double duckbill valve 284' and out a proximal end of the double duckbill valve 284'. Similar or the same elements as those depicted and discussed in FIGS. 5A and 5B are depicted in FIG. 5C with a "prime" symbol. To aid in depicting what the double duckbill valve 284' looks like when air flow passes through the valve, a tweezers is depicted as squeezing between the valve lips 300', 302' and the base portion 290', which causes the valve lip 298' to open. When air flows through the double duckbill valve, out of the slits 300', 302', one or more of the valve lips 296', 298' can be spread apart, thus widening one or more of the slits 300', 302'. This can allow air to pass through the slits 300', 302' and into a chamber air inlet 186 (FIG. 2C), for example. When air is not passing through the slits 300', 302', the slits can remain closed, as depicted in FIGS. 5A and 5B. In the alternative, when an air flow is present on the proximal side of the double duckbill valve 284', the slits 300', 302' can remain closed. For example, when an increased pressure is present on the proximal side of the double duckbill valve 284', the valve lips 296', 298' can be pressed together, causing the slits 300', 302' to be sealed. This then prevents air and/or liquid from leaking through the slits 300', 302' and out a distal end of the double duckbill valve 284'.

Figure 6A:
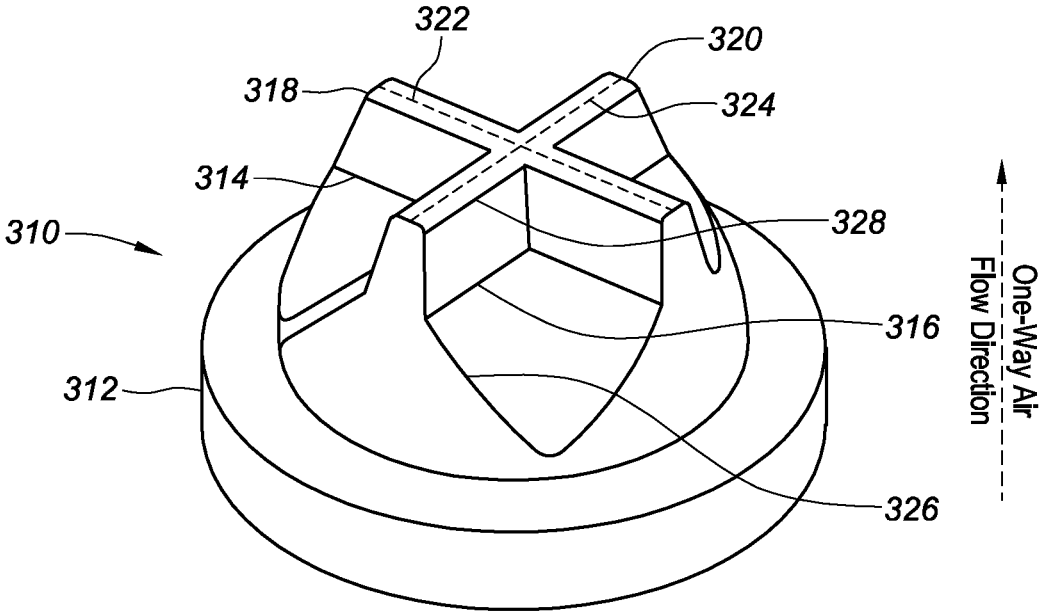
FIG. 6A is an isometric side and top view of a double duckbill valve.

FIG. 6A depicts an isometric side and top view of a double duckbill valve 310. The double duckbill valve 310 can include the same or similar features as those discussed in relation to the valves depicted and discussed in relation to FIGS. 5A to 5C. As depicted, the double duckbill valve 310 can include a base portion 312. In contrast to the double duckbill valve 284 depicted in FIGS. 5A to 5C, the double duckbill valve 310 of FIG. 6 may not include a flattened side 288. The double duckbill valve 310 can include valve bodies 314, 316, which can extend away from the base portion 312, in a proximal direction. In some embodiments, the cross-sectional width of the valve bodies 314, 316 can decrease from the base portion 312 to the corresponding valve lips 318, 320 of each valve body 314, 316. In an example, the cross-sectional width of the valve bodies 314, 316 can decrease at a different rate. For example, a cross-sectional width of a distal portion 326 of the valve body 316 can decrease at a lower rate than a proximal portion 328. In some embodiments, a wider distal portion 326 of the valve body 316 can provide an increased stability to the valve body, while the proximal portion 328 of the valve body 316 can still readily open and close, while providing a fluid tight seal when introduced to a reverse flow direction. In some embodiments, the valve lips 314, 316 can define slits 322, 324 in proximal faces of each one of the valve bodies 314, 316. In an example, as air flows through the double duckbill valve 310 from the distal end out of the proximal end, the slits 322, 324 can open and air can pass out of the proximal end of the double duckbill valve 310.

Figure 6B:
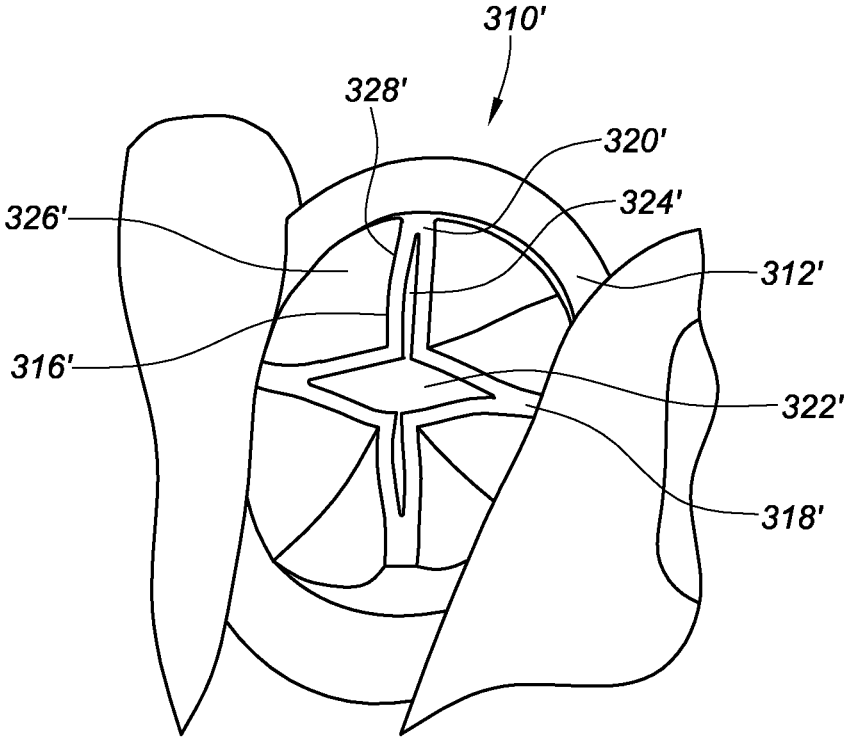
FIG. 6B is a top view of the double duckbill valve of FIG. 6A, in an open configuration.

FIG. 6B further depicts the double duckbill valve 310' of FIG. 6A in an open configuration, which allows an air flow to pass from a distal end through the double duckbill valve 310' and out a proximal end of the double duckbill valve 310'. In some embodiments, a lower draw strength can be required to open a double duckbill valve than a single duckbill valve. Similar or the same elements as those depicted and discussed in FIG. 6A are depicted in FIG. 6B with a "prime" symbol. To aid in depicting what the double duckbill valve 310' looks like when air flow passes through the valve, a pair of fingers is depicted as squeezing between the valve lip 318' and the base portion 312', which causes the valve lip 318' to open. When air flows through the double duckbill valve, out of the slits 322', 324', one or more of the valve lips 318', 320' can be spread apart, thus widening one or more of the slits 322', 324'. This can allow air to pass through the slits 322', 324' and into a chamber air inlet 186 (FIG. 2C), for example. When air is not passing through the slits 322', 324', the slits can remain closed, as depicted in FIG. 6A. In the alternative, when an air flow is present on the proximal side of the double duckbill valve 310', the slits 322', 324' can remain closed. For example, when an increased pressure is present on the proximal side of the double duckbill valve 310', the valve lips 318', 320' can be pressed together, causing the slits 322', 324' to be sealed. This then prevents air and/or liquid from leaking through the slits 322', 324' and out a distal end of the double duckbill valve 310'.

In some embodiments, the double duckbill valves discussed herein can be formed from a material that has a durometer of approximately 20 shore A durometer. In some embodiments, the durometer can be in a range from 15 to 25 shore A durometer.

Figure 7A:
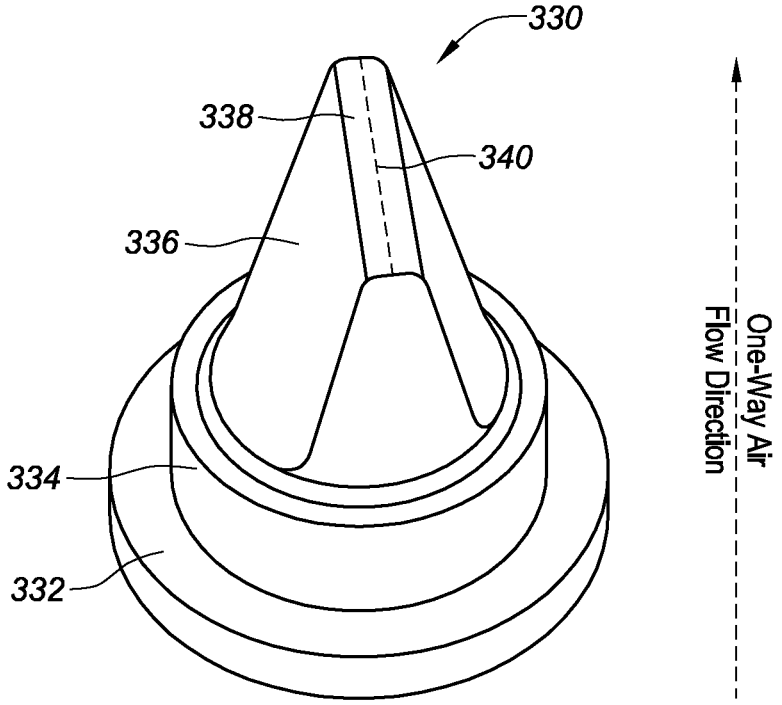
FIGS. 7A and 7B depict isometric side views of a single duckbill valve.
Figure 7B:
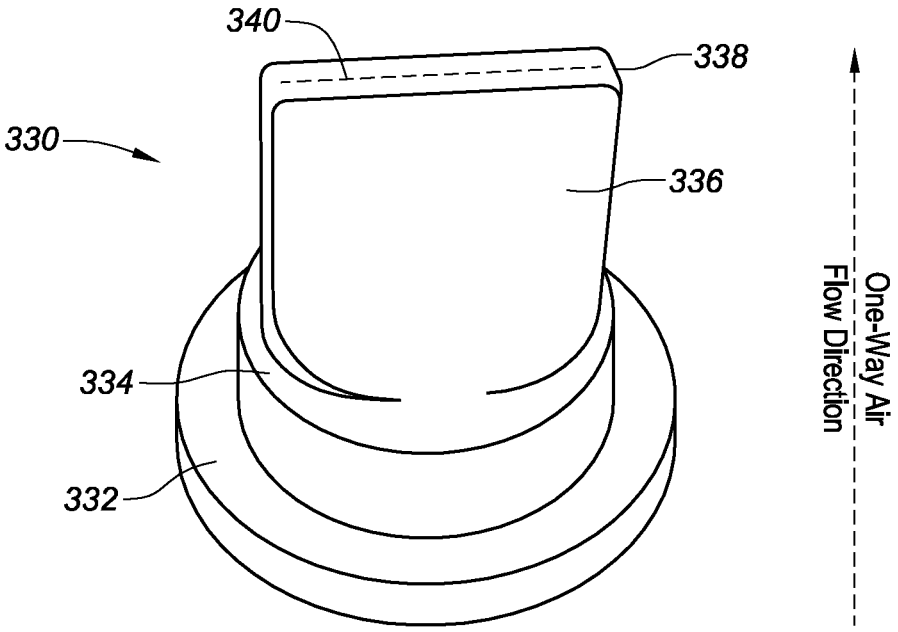

FIGS. 7A and 7B depict isometric side views of a single duckbill valve 330. As depicted, the single duckbill valve 330 can include a base portion 332. The single duckbill valve 330 can include a valve body 336, which can extend away from the base portion 332, in a proximal direction. As further depicted, a throat portion 334 can be included between the valve body 336 and the base portion 332. The throat portion 334 can add some rigidity to the single duckbill valve 330, such that the single duckbill valve 330 can be mounted using the base portion 332 and the throat portion 334. In some embodiments, the cross-sectional width of the valve body 336 can decrease from the throat portion 334 to a valve lip 338 located at a distal end of the valve body 336. In some embodiments, the valve lip 338 can define a slit 340 in a proximal face of the valve body 336. In an example, as air flows through the single duckbill valve 330 from the distal end out of the proximal end, the slit 340 can open and air can pass out of the proximal end of the single duckbill valve 330. In the presence of a reverse fluid flow, in a direction that is opposite of the depicted one-way air flow direction, the valve lip 338 can be forced closed, sealing the slit 340 and helping to prevent fluid from leaking through the slit 340 distally through the single duckbill valve 330.

Figure 8A:
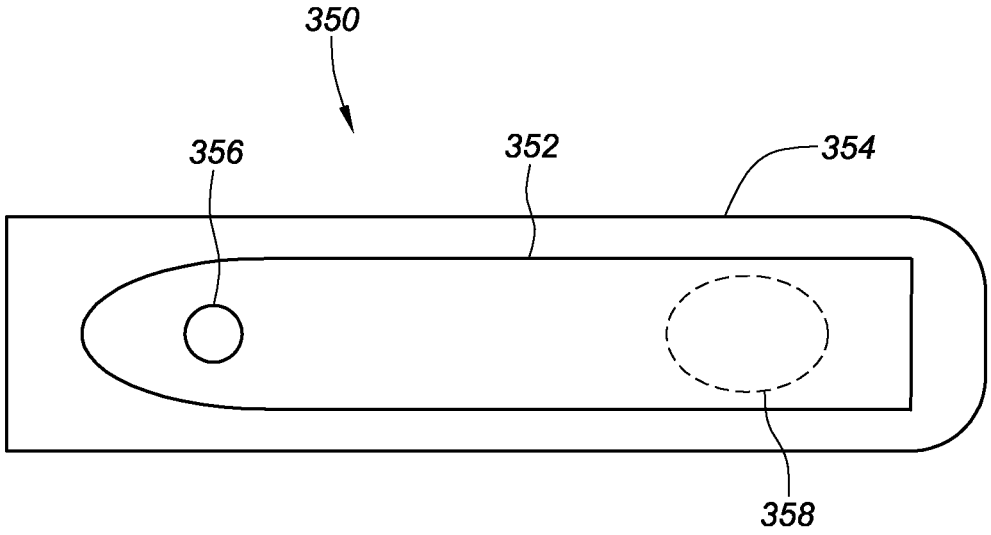
FIG. 8A is a top view of a reed valve.
Figure 8B:
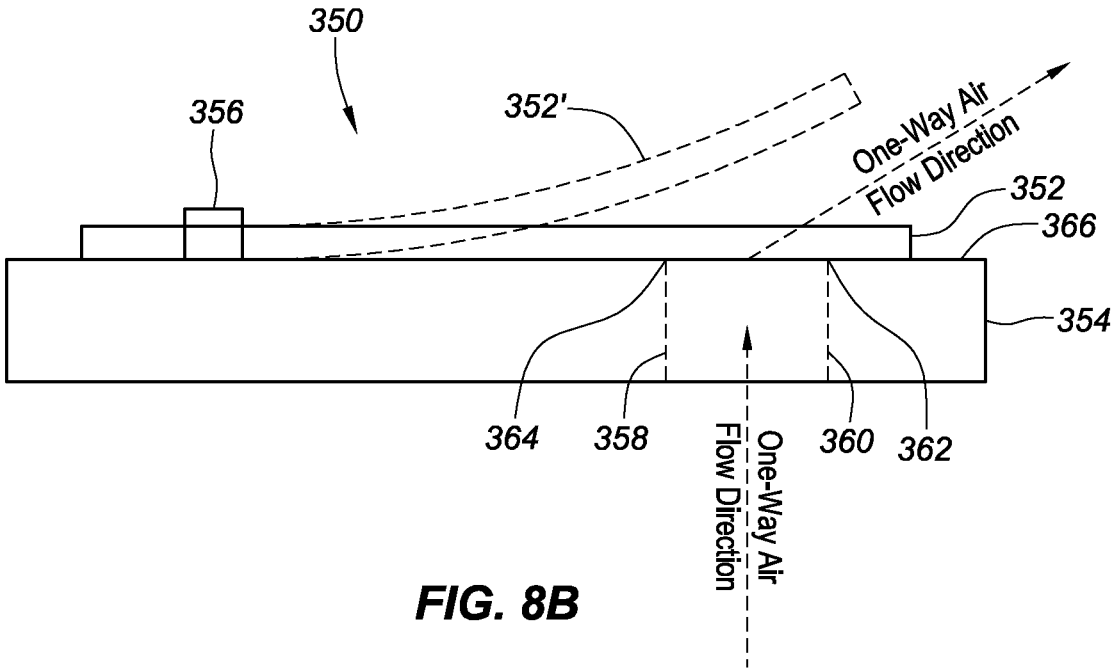
FIG. 8B is a side view of a reed valve in an open configuration.

FIG. 8A depicts a top view of a reed valve 350 and FIG. 8B depicts a side view of the reed valve 350. The reed valve can include a reed 352 that is coupled to a carrier 354 via a fastener 356. In some embodiments, the reed 352 can be a planar flexible piece of material that is fastened to the carrier 354. For example, in a naturally biased position, the reed 352 can create a seal against a first side of the carrier 354. For example, in a naturally biased position, the reed 352 can be seated on the first side of the carrier 354 to create a fluid tight seal when a fluid flow is in a direction opposite of the one way air flow direction, depicted in FIG. 8B. In some embodiments, the reed 352 can be formed from a planar piece of flexible plastic, metal, carbon fiber, or other type of material that can be naturally biased to be seated against the first side of the carrier 354, but can be flexible enough to unseat from the first side of the carrier 354 in the presence of air flow through a valve lumen 358, positioned beneath an unanchored side of the reed 352. Particular examples of the material that the reed 352 can be formed from can include silicone or mylar, although examples are not so limited. For example, a valve lumen 358 can be defined by the carrier 354 and can have a valve inlet 360 on a bottom of the carrier 354 and an outlet 362 on a side of the carrier on which a sealing portion 364 of the reed 352 is disposed against. In some embodiments, a flexible material can surround the valve lumen 358. In an example, the flexible material can surround an outlet 362 of the valve lumen to create an increased seal between the interface of the reed 352 and the outlet of the valve lumen.

In some embodiments, a first side of the reed 352 can be coupled to the carrier 354 via the fastener 356. In an example, the fastener 356 can be chosen from various types of fasteners. In an example, the fastener 356 can be a pin, screw, etc. In an example where a pin is used, the pin can be heat staked, creating an interference fit between the first side of the reed 352, the pin (e.g., fastener 356), and the carrier 354.

In some embodiments, the reed valve 350 can be disposed in an electronic cigarette, as discussed herein. For example, the reed valve 350 can be included in a battery connector 260 (FIGS. 4A and 4B), in some embodiments. In an example, in a no-flow condition, where a fluid is not flowing though the valve inlet 360 in a direction of the one-way air flow direction, the reed 352 can be disposed in a naturally biased position, where the sealing surface 364 of the reed 352 is disposed against a first side 366 of the carrier 354. Accordingly, when a fluid flow occurs in a direction opposite to the one-way air flow direction (e.g., when a user blows on a proximal end of an electronic cigarette), the sealing surface of the reed 352 can remain sealed against the first side 366 of the carrier 354. In contrast, when an air/fluid flow is present in a direction of the one-way air flow direction, the movable portion of the reed 352' (i.e., the side of the reed 352 not secured to the carrier 354) can be deflected due to the force of the air/fluid flow, causing the reed 352', represented by the phantom lines to assume a second position. This can allow the air/fluid flow to pass through the valve inlet, out of the valve outlet 362, around the reed 352' and into the electronic cigarette. When the air/fluid flow in the direction of the one-way air flow direction stops, the reed 352' can return to its naturally biased position 352, creating a seal between the sealing surface 364 of the reed 352 and the first side 366 of the carrier 354.

Figure 9A:
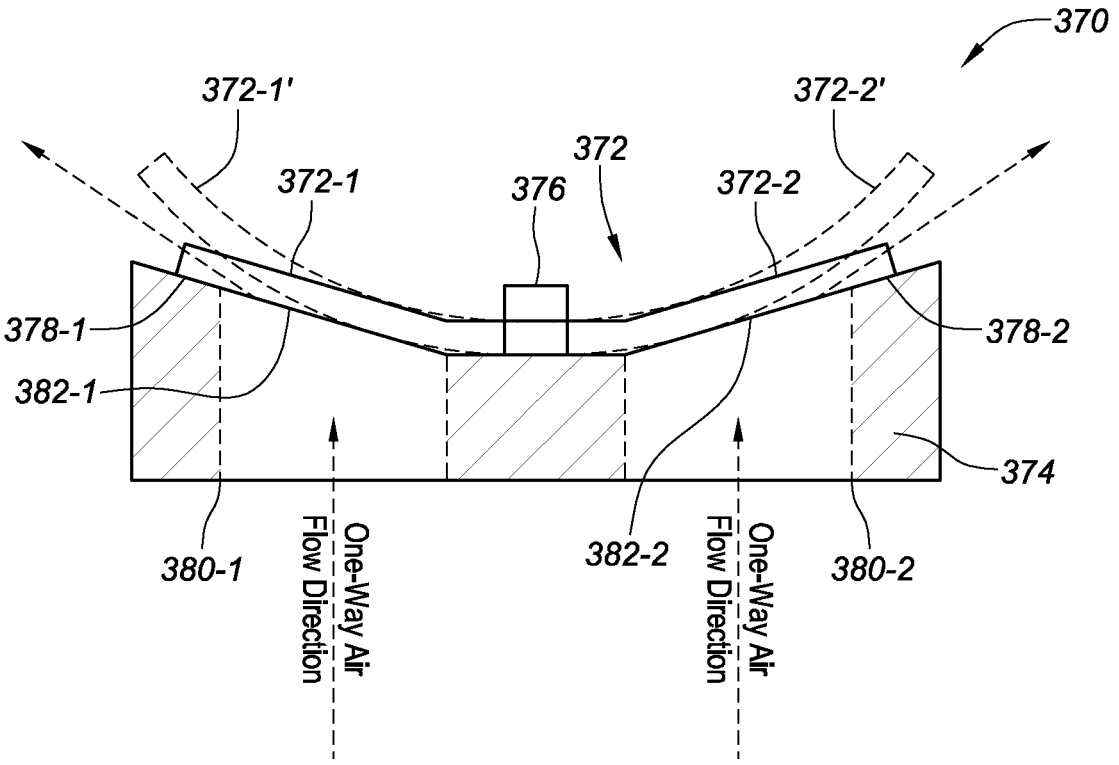
FIG. 9A is a side view of a double reed valve 370.

FIG. 9A depicts a side view of a double reed valve 370. The double reed valve 370 can include a double reed 372 that is coupled to a carrier 374 via a fastener 376. In some embodiments, the double reed 372 can be a planar flexible piece of material that is fastened to the carrier 374. In some embodiments, a center of the double reed 372 can be fastened to the carrier via a fastener 376, as discussed in relation to FIG. 8. The double reed 372 can have a first portion 372-1 that extends to one side of the fastener 376 and a second portion 372-2 that extends to a second side 372-2 of the fastener 376. For example, in a naturally biased position, the double reed 372 can create a seal against a first side of the carrier 374 along a first portion 378-1 and a second portion 378-2. For example, in a naturally biased position, the double reed 372 can be seated on the first side of the carrier 374 to create a fluid tight seal when a fluid flow is in a direction opposite of the one way air flow direction, depicted in FIG. 9A. In some embodiments, the double reed 372 can be formed from a planar piece of flexible plastic, metal, carbon fiber, or other type of material that can be naturally biased to be seated against the first side of the carrier 374, but can be flexible enough to unseat from the first side and first and second portions 378-1, 378-2 of the carrier 374 in the presence of air flow through a pair of valve lumens 380-1, 380-2, positioned beneath the unanchored sides of the double reed 372. For example, valve lumens 380-1, 380-2 can be defined by the carrier 374 and can have valve inlets on a bottom side of the carrier 374 and valve outlets on a side of the carrier 374 against which sealing portions 382-1, 383-2 of the double reed 372 are disposed. For example, the sealing portions 381-1, 382-2 of the double reed 372 can be disposed against the side of the carrier 374 that includes the first and second portions 378-1, 378-2.

In some embodiments, a middle of the double reed 372 can be coupled to the carrier 374 via the fastener 376. In an example, the fastener 376 can be chosen from various types of fasteners. In an example, the fastener 376 can be a pin, screw, etc. In an example where a pin is used, the pin can be heat staked, creating an interference fit between the first side of the double reed 372, the pin (e.g., fastener 376), and the carrier 374.

In some embodiments, the double reed valve 370 can be disposed in an electronic cigarette, as discussed herein. For example, the reed valve 370 can be included in a battery connector 260 (FIGS. 4A and 4B), in some embodiments. In an example, in a no-flow condition, where a fluid is not flowing though the valve inlet in a direction of the one-way air flow direction, the double reed 372 can be disposed in a naturally biased position, where the sealing surface 382-1, 382-2 of the double reed 372 is disposed against a first side of the carrier 374. Accordingly, when a fluid flow occurs in a direction opposite to the one-way air flow direction (e.g., when a user blows on a proximal end of an electronic cigarette), the sealing surface of the double reed 382-1, 382-2 can remain sealed against the first side of the carrier 374 and the first and second portions 378-1, 378-2. In contrast, when an air/fluid flow is present in a direction of the one-way air flow direction, the movable portions of the double reed 372-1', 372-2' (i.e., the side of the reed 372 not secured to the carrier 374) can be deflected due to the force of the air/fluid flow, causing the movable portions of the reed 372-1', 372-2', represented by the phantom lines to assume a second position. This can allow the air/fluid flow to pass through the valve inlet, out of the valve outlet, around the first and second movable portions 372-1', 372-2' of the double reed 372 and into the electronic cigarette. When the air/fluid flow in the direction of the one-way air flow direction stops, the movable portions of the double reed 372-1', 372-2' can return to their naturally biased positions 372-1, 372-2, creating a seal between the sealing surface of the double reed 382-1, 382-2 of the double reed 372 and the first side of the carrier 374.

As depicted in FIG. 9A, the carrier 374 can have a concave sealing surface, which in some embodiments can provide a better sealing surface against which the double reed 372 can be disposed. For example, in some embodiments, the double reed 372 can be formed from a planar piece of substrate that is flat and does not have a curvature to the substrate (e.g., is naturally biased such that it is flat and not curved). The planar piece of substrate can be fastened to the carrier 374 via the fastener 376, such that the planar piece of substrate assumes a curvature of the concave sealing surface of the carrier 374. Accordingly, because the planar piece of substrate can be fastened to the carrier 374 and assumes the curvature of the concave sealing surface, the planar piece of substrate can exert a force against the sealing surface of the carrier, helping to create a more fluid tight seal. However, as depicted in FIG. 9B, the carrier 374 can have a flat sealing surface in some embodiments, as well.

Figure 9B:
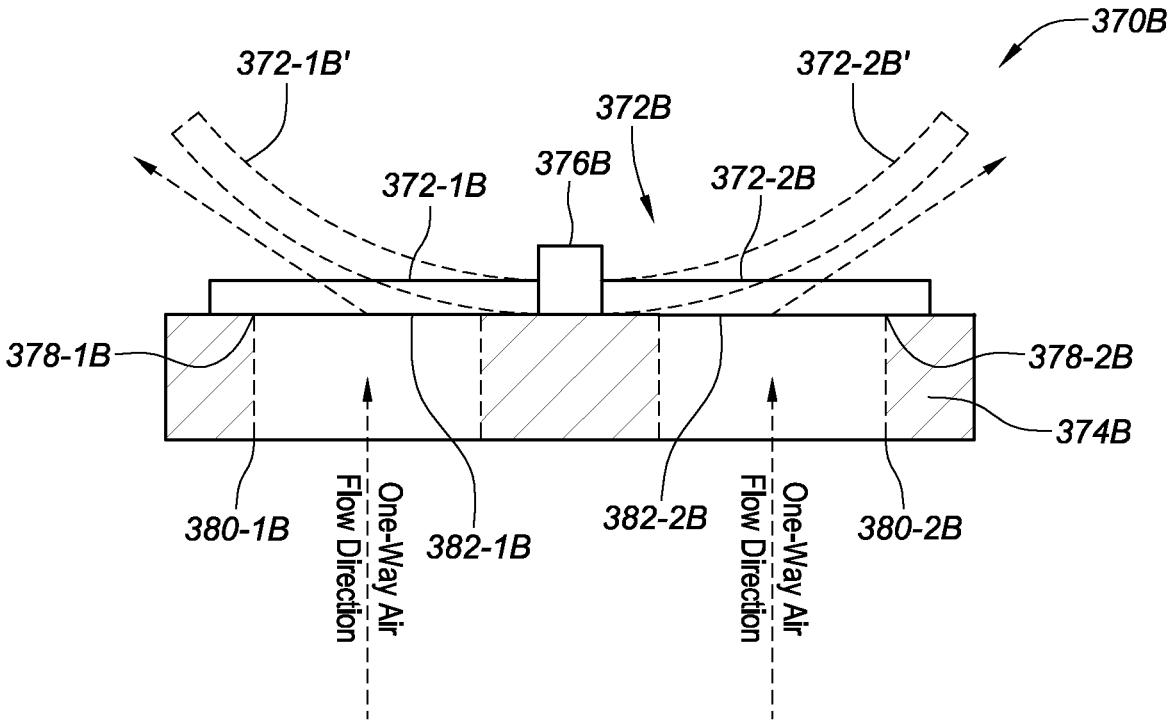
FIG. 9B is a side view of a double reed valve that includes a carrier with a flat sealing surface.

As discussed, FIG. 9B depicts a carrier 374B with a flat sealing surface. FIG. 9B depicts similar or the same elements as those depicted in FIG. 9A, denoted by the similar numbering, with the exception that the sealing surface of the carrier 374B is flat. In some embodiments, the double reed 372B can be a planar flexible piece of material that is fastened to the carrier 374B. In some embodiments, a center of the double reed 372B can be fastened to the carrier via a fastener 376B, as discussed in relation to FIG. 8. The double reed 372B can have a first portion 372-1 that extends to one side of the fastener 376B and a second portion 372-2B that extends to a second side 372-2B of the fastener 376B. For example, in a naturally biased position, the double reed 372B can create a seal against a first side of the carrier 374B along a first portion 378-1B and a second portion 378-2B. For example, in a naturally biased position, the double reed 372B can be seated on the first side of the carrier 374B to create a fluid tight seal when a fluid flow is in a direction opposite of the one way air flow direction, depicted in FIG. 9B. In some embodiments, the double reed 372B can be formed from a planar piece of flexible plastic, metal, carbon fiber, or other type of material that can be naturally biased to be seated against the first side of the carrier 374B, but can be flexible enough to unseat from the first side and first and second portions 378-1B, 378-2B of the carrier 374B in the presence of air flow through a pair of valve lumens 380-1B, 380-2B, positioned beneath the unanchored sides of the double reed 372B. For example, valve lumens 380-1B, 380-2B can be defined by the carrier 374B and can have valve inlets on a bottom side of the carrier 374B and valve outlets on a side of the carrier 374B against which sealing portions 382-1B, 383-2B of the double reed 372B are disposed. For example, the sealing portions 381-1B, 382-2B of the double reed 372B can be disposed against the side of the carrier 374B that includes the first and second portions 378-1B, 378-2B. As previously discussed, the carrier 374B can have a flat sealing surface against which the double reed 372B is disposed.

In some embodiments, a middle of the double reed 372 can be coupled to the carrier 374 via the fastener 376. In an example, the fastener 376 can be chosen from various types of fasteners. In an example, the fastener 376 can be a pin, screw, etc. In an example where a pin is used, the pin can be heat staked, creating an interference fit between the first side of the double reed 372, the pin (e.g., fastener 376), and the carrier 374.

In some embodiments, the double reed valve 370B can be disposed in an electronic cigarette, as discussed herein. For example, the reed valve 370B can be included in a battery connector 260 (FIGS. 4A and 4B), in some embodiments. In an example, in a no-flow condition, where a fluid is not flowing though the valve inlet in a direction of the one-way air flow direction, the double reed 372B can be disposed in a naturally biased position, where the sealing surface 382-1B, 382-2B of the double reed 372B is disposed against a first side of the carrier 374B. Accordingly, when a fluid flow occurs in a direction opposite to the one-way air flow direction (e.g., when a user blows on a proximal end of an electronic cigarette), the sealing surface of the double reed 382-1B, 382-2B can remain sealed against the first side of the carrier 374B and the first and second portions 378-1B, 378-2B. In contrast, when an air/fluid flow is present in a direction of the one-way air flow direction, the movable portions of the double reed 372-1B', 372-2B' (i.e., the side of the reed 372B not secured to the carrier 374B) can be deflected due to the force of the air/fluid flow, causing the movable portions of the reed 372-1B', 372-2B', represented by the phantom lines to assume a second position. This can allow the air/fluid flow to pass through the valve inlet, out of the valve outlet, around the first and second movable portions 372-1B', 372-2B' of the double reed 372B and into the electronic cigarette. When the air/fluid flow in the direction of the one-way air flow direction stops, the movable portions of the double reed 372-1B', 372-2B' can return to their naturally biased positions 372-1B, 372-2B, creating a seal between the sealing surface of the double reed 382-1B, 382-2B of the double reed 372B and the first side of the carrier 374B.

As depicted in FIG. 9B, the carrier 374B can have a flat sealing surface, which in some embodiments can provide a surface against which the double reed 372 can be disposed. In contrast to the embodiments discussed in relation to FIG. 9A, a decreased amount of force can be provided between the sealing surfaces of the double reed 382-1B, 382-2B. However, an amount of space required for the double reed valve to be disposed within the electronic cigarette can be reduced. For example, an extra height associated with the carrier 374B, due to the curvature of the carrier may not be needed.

Figure 10A:
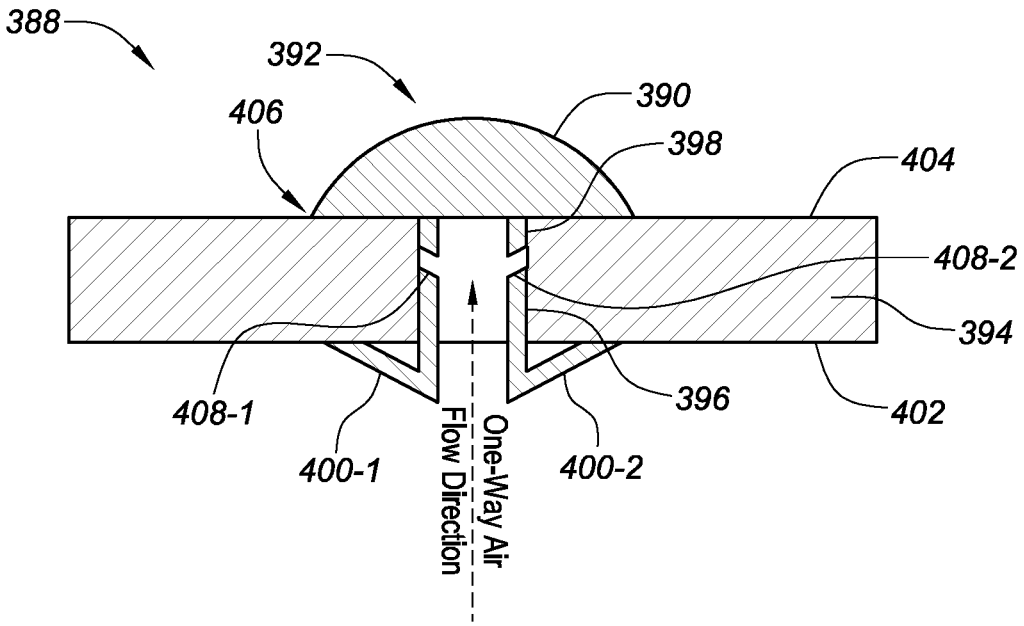
FIG. 10A is a cross-sectional side view of a umbrella valve assembly that includes a domed valve insert included in a valve carrier.

FIG. 10A depicts a cross-sectional side view of a umbrella valve assembly 388 that includes a domed valve insert 392 included in a valve carrier 394. In some embodiments, the valve carrier 394 can define an air passageway 396, which can be a lumen, which extends through the valve carrier 394. As depicted, a valve shaft 398 can extend distally from a valve sealing dome 390 through the air passageway 396 and can be a hollow tube. In some embodiments, air outlets 408-1, 408-2 can be defined in a sidewall of the valve shaft 398. The air outlets 408-1, 408-2 can fluidly couple an exterior surface of the valve shaft 398 with an interior lumen of the valve shaft 398. A biasing member(s) 400-1, 400-2 can extend laterally from a distal base portion of the valve shaft 398, in some embodiments. The biasing member 400-1, 400-2 can extend a lateral distance that is larger than a diameter of the air passageway 396, in some embodiments, such that lateral ends of the biasing member 400-1, 400-2 contact a bottom side 402 of the valve carrier 394. In some embodiments, the valve dome insert 392 can be formed from a flexible material. For example, the valve dome insert 392 can be formed from a rubber material (e.g., silicon), which provides a flexibility to the valve dome insert 392. In some embodiments, the biasing member 400-1, 400-2 can provide a biasing force against the bottom side 402 of the valve carrier 394. For example, the biasing member 400-1, 400-2 can provide a biasing force against the bottom side 402 of the valve carrier 394, such that the biasing member 400-1, 400-2 pulls the valve shaft 398 distally towards the bottom side 402 of the valve carrier 394 and in turn pulls the valve sealing dome 390 against a top surface 404 of the valve carrier 394, creating a sealed interface 406 between mating portions of the valve sealing dome 390 and the top surface 404 of the valve carrier 394. Accordingly, when a fluid flow in a direction opposite the one-way air flow direction is present, the fluid is prevented from leaking from a top side 404 of the valve carrier 394 past the sealed interface 406 and out through a bottom of the air passageway 396.

Figure 10B:
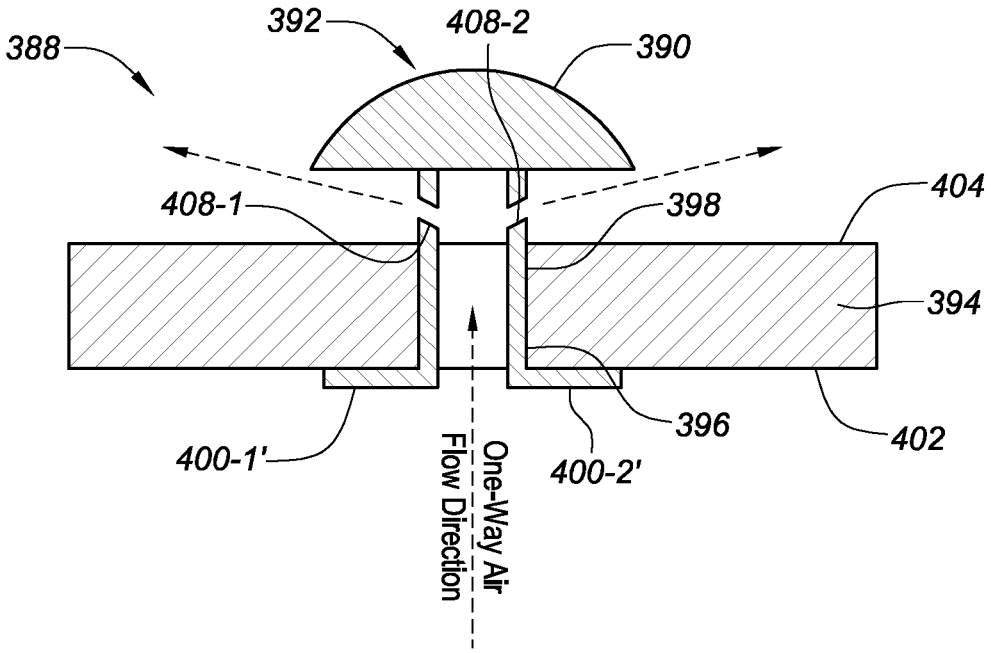
FIG. 10B is a cross-sectional side view of an umbrella valve assembly that includes a domed valve insert in an open position, included in a valve carrier.

FIG. 10B is a cross-sectional side view of a umbrella valve assembly 388 that includes a domed valve insert 392 in an open position, included in a valve carrier 394. In some embodiments, when air flow is present in the one-way air flow direction, pressure from the air flow can cause the sealing dome 390 to be lifted proximally, away from the top surface 404 of the valve carrier 394. The lifting of the sealing dome 390, along with the valve shaft 398 can cause the biasing members 400-1', 400-2' to deflect, allowing for the valve shaft 398 and the sealing dome 390 to be raised. As the valve shaft 398 is raised, the air outlets 408-1, 408-2 can be raised above the top surface 404 of the valve carrier 394, causing an area adjacent to the top surface 404 of the valve carrier 394 to be in fluid communication with an interior lumen of the valve shaft 398 and thus to also be in fluid communication with an area adjacent to the bottom surface 402 of the valve carrier. Thus, air can freely flow in the direction of the one-way air flow direction and out the air outlets 408-1, 408-2 along the path depicted by the phantom arrows. When the air flow ceases (e.g., a user ceases to suck on the electronic cigarette), the biasing members 400-1', 400-2' can return to their naturally biased position, shown in FIG. 10A with element numbers 400-1, 400-2, again creating the sealed interface 406, preventing fluid from leaking out the distal end of the air passageway.

Figure 11A:
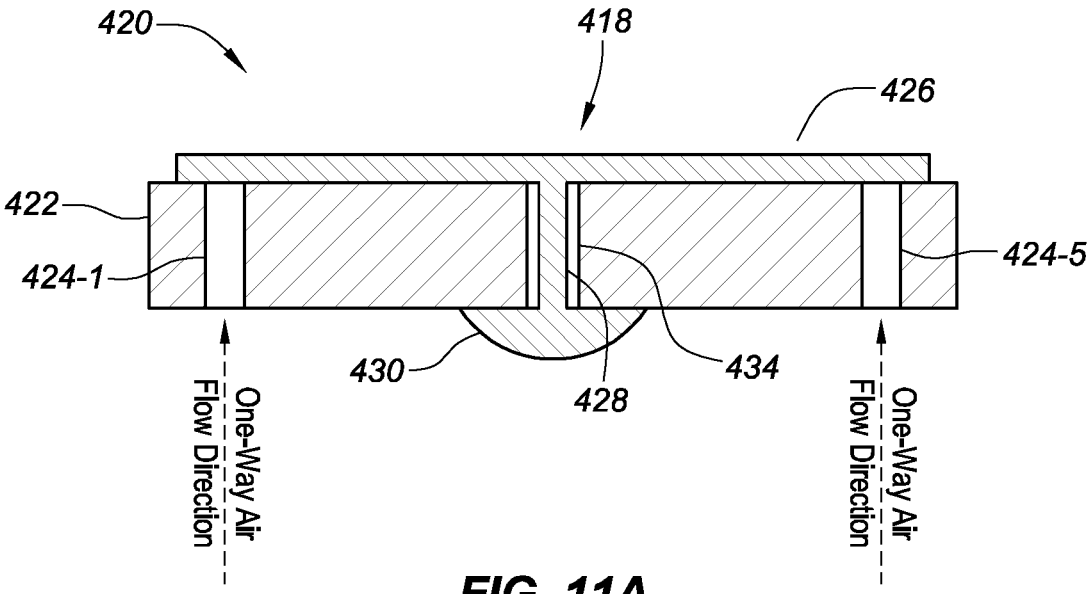
FIG. 11A is a cross-sectional side view of an umbrella valve assembly.
Figure 11B:
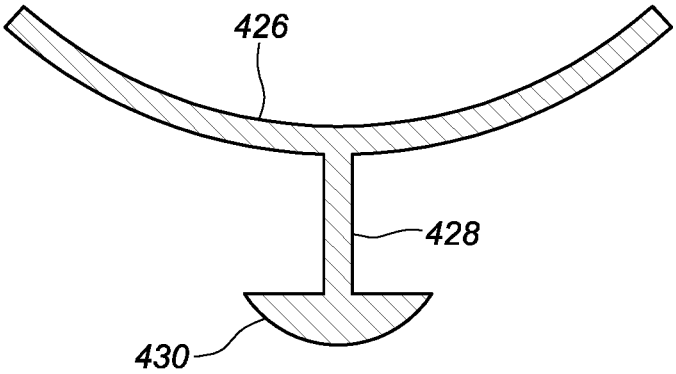
FIG. 11B is a cross-sectional side view of a lifted valve flap depicted in FIG. 11A.
Figure 11C:
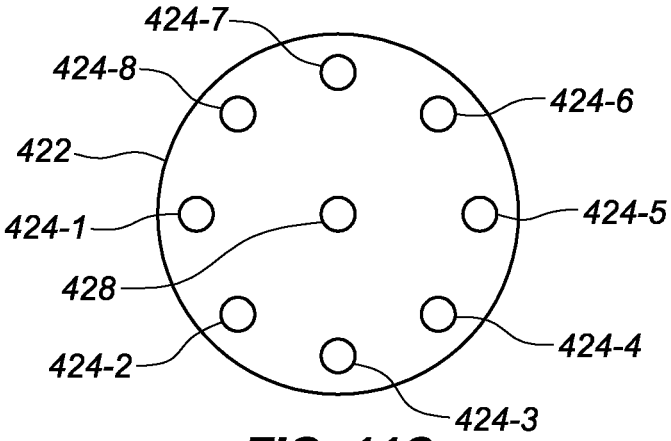
FIG. 11C is a top view of a valve carrier that includes a plurality of air inlet lumens.

FIG. 11A depicts a cross-sectional side view of an umbrella valve assembly 420. As depicted in FIG. 11A, the umbrella valve assembly 420 can include a valve carrier 422, in which a plurality of air inlet lumens 424-1, 424-2, 424-8 can be defined, as depicted in FIG. 11C. Although 8 air inlet lumens are depicted, greater than or fewer than 8 air inlet lumens can be defined in the valve carrier 422. The umbrella valve assembly 420 can include an umbrella valve 418, which includes a valve flap 426 and a valve shaft 428 that extends distally, away from, valve flap 426. The valve flap 426 can be any shape, including a circle, oval, square, etc. A valve retainer 430 can be connected to a distal end of the valve shaft 428. The valve shaft 428 can be disposed in a valve shaft lumen 434 and the valve retainer can be disposed on an intake side of the valve carrier 422, retaining the valve shaft 428 and the circular valve flap 426.

In some embodiments, the valve flap 426 can be naturally biased such that it contacts an outlet side of the valve carrier 422, creating a sealed surface that covers an outlet side of each one of the air inlet lumens 424-1, 424-2, 424-8. In an example, when air flow through the air inlet lumens 424-1, 424-2, 424-8 is not present in the direction of the one-way air flow direction, the valve flap 426 can create a seal over the outlet side of each one of the air inlet lumens 424-1, 424-2, 424-8, preventing a back flow of fluid through the outlet side of each one of the air inlet lumens 424-1, 424-2, 424-8.

When a user draws air into an electronic cigarette, air can be drawn into each one of the air inlet lumens 424-1, 424-2, 424-8. The air can travel through each one of the air flow lumens and towards the valve flap 426, causing the valve flap 426 to lift, as depicted in FIG. 11B. A seal between the valve flap 426 and the outlet side of each one of the air inlet lumens 424-1, 424-2, 424-8 can be released, allowing for air to flow out each one of the air inlet lumens 424-1, 424-2, 424-8. When air flow in the direction of the one-way air flow direction stops, the valve flap 426 can return to its naturally biased position, creating a seal between the valve flap 426 and the outlet side of each one of the air inlet lumens 424-1, 424-2, 424-8.

Figure 12:
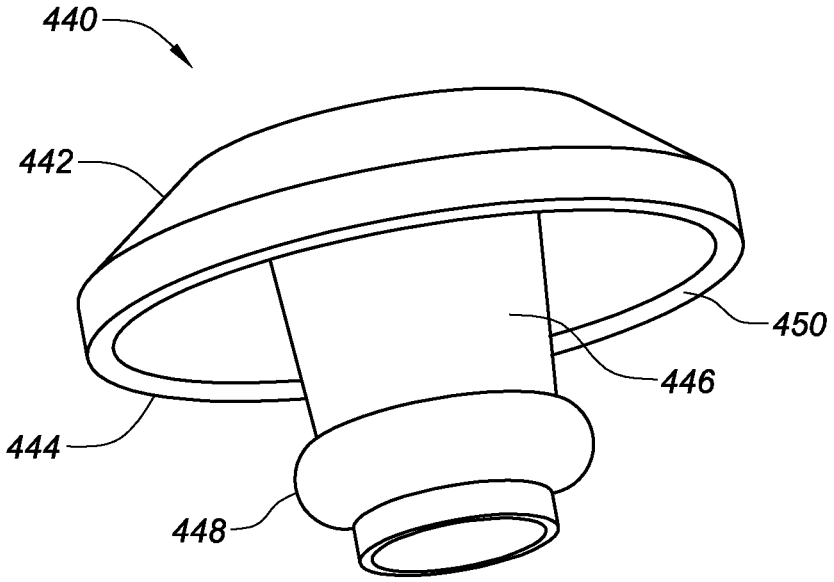
FIG. 12 is an isometric view of an umbrella valve with a domed valve head.

FIG. 12 depicts an umbrella valve 440, with a domed valve head 442. The umbrella valve 440 can include similar features to the umbrella valve 418 depicted and discussed in relation to FIGS. 11A and 11B, with the exception that the umbrella valve 40 includes a domed valve head 442. In an example, the domed valve head 442 can include a sealing perimeter 444, which can form a seal when placed in contact with an outlet side of a valve carrier, such as the one depicted in FIGS. 11A and 11C. The outlet side of each one of the air inlet lumens can be contained within the sealing perimeter 444, such that the domed valve head 442 covers the outlet side of each one of the air inlet lumens. The umbrella valve 440 further includes a valve shaft 446. The valve shaft 446 can be attached to an interior of the domed valve head 442 and can extend away from the domed valve head 442, in a similar fashion to that depicted in FIG. 11A. In some embodiments, the sealing perimeter 444 can contact the outlet side of the valve carrier and can be held in contact by the valve shaft 446, as well as a retaining feature 448. For example, the valve shaft 446 and the retaining feature 448 can be disposed within a valve shaft lumen, as depicted and discussed in relation to FIG. 11A. The retaining feature 448, in some embodiments, can be disposed on an inlet side of a valve shaft lumen, thus helping to retain the valve shaft 446 and the domed valve head 442 in fixed relation to the valve carrier.

In some embodiments, the umbrella valve can be formed from a flexible material, such as a rubber (e.g., silicone). When air passes through the air inlet lumens, a pressure differential between an interior and exterior of the dome can cause the dome to deform, breaking a seal between an interface of the sealing perimeter 444 and an outlet side of the valve carrier. In some embodiments, the sealing perimeter 444 can include a recessed lip 450. The recessed lip 450 can have a reduced thickness with respect to the rest of the domed valve head 442. The area of reduced thickness can increase a flexibility of the recessed lip 450, allowing for the recessed lip 450 to better conform to an outlet side of the valve carrier. Further, due to the increased flexibility of the recessed lip 450, the recessed lip can deform more easily, which can result in a decrease in needed pressure differential to cause the sealing perimeter 444 to deform, allowing air to pass between the sealing perimeter 444 and the outlet side of the valve carrier.

Figure 13:
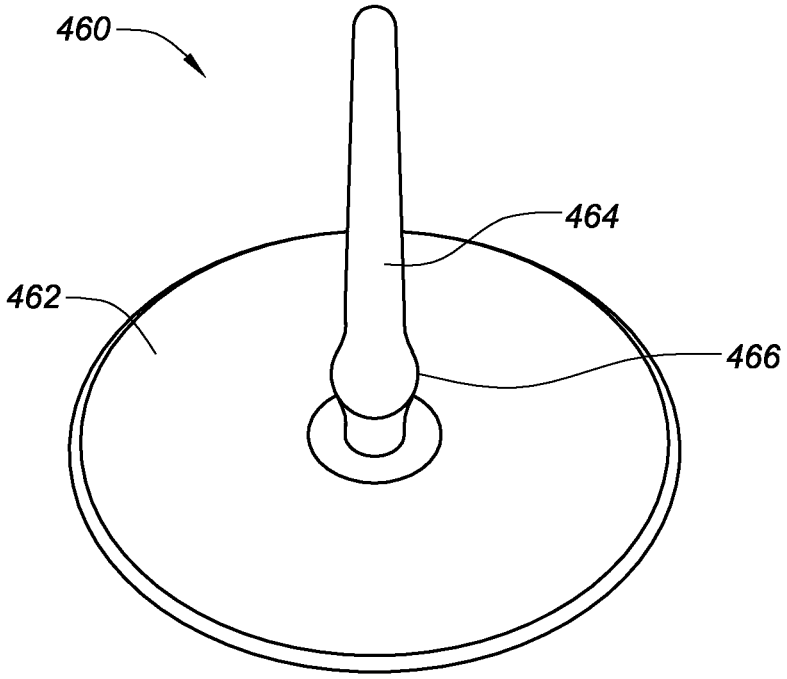
FIG. 13 is an isometric view of an umbrella valve.

FIG. 13 depicts an isometric view of an umbrella valve 460. The umbrella valve 460 can include features similar to or the same as those discussed in relation to FIGS. 11A to 11C. The umbrella valve can include a valve flap 462, which can be connected to a valve shaft 464. The valve shaft 464 can be inserted into a lumen defined by a valve carrier, such that a side of the valve flap 462 connected to the valve shaft 464 is disposed adjacent to the valve carrier. In some embodiments, the valve shaft 464 can include a valve shaft retainer 466, which can be disposed into the lumen defined by the valve carrier. In some embodiments, the umbrella valve 460 can be formed from a flexible material to allow the valve flap 462 to deflect and the valve shaft retainer 466 to deform when disposed in the lumen defined by the valve carrier. In an example, the umbrella valve 460 can be formed from a rubber, such as a silicon rubber. In some embodiments, the valve shaft retainer 466 can be of a larger cross-sectional diameter than the lumen defined by the valve carrier, such that the valve shaft retainer 466 can be compressed within the lumen defined by the valve carrier, retaining the valve shaft 464 and the valve flap 462. In some embodiments, the retaining valve shaft can be longer than necessary, such that it can be threaded through a lumen defined by the valve carrier and pulled in order to pull the valve shaft retainer 466 through the lumen. Once the valve shaft retainer 466 has been pulled through the lumen, the excess length of the valve shaft retainer 466 can be trimmed.

In some embodiments, air can flow through the air inlet lumens and out an outlet side of each one of the air inlet lumens, as further discussed in FIGS. 11A to 11C. As further discussed, in FIGS. 11A to 11C, the air inlet lumens can be disposed beneath the valve flap 462. As air exits the outlet side of each one of the air inlet lumens, the valve flap 462 can be deflected due to the force of the air exiting the lumens, thus allowing air to flow into an electronic cigarette. In some embodiments, when the air flow stops, the valve flap 462 can return to its seated position against the outlet side of the valve carrier, thus creating a seal that prevents a backflow of fluid, as further discussed herein.

Embodiments are described herein of various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," or "an embodiment", or the like, means that a particular feature, structure, or characteristic described in connection with the embodiment(s) is included in at least one embodiment. Thus, appearances of the phrases "in various embodiments," "in some embodiments," "in one embodiment," or "in an embodiment," or the like, in places throughout the specification, are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

Although at least one embodiment of a device for storing and vaporizing liquid media has been described above with a certain degree of particularity, those skilled in the art could make numerous alterations to the disclosed embodiments without departing from the spirit or scope of this disclosure. All directional references (e.g., upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of the devices. Joinder references (e.g., affixed, attached, coupled, connected, and the like) are to be construed broadly and can include intermediate members between a connection of elements and relative movement between elements. As such, joinder references do not necessarily infer that two elements are directly connected and in fixed relationship to each other. It is intended that all matter contained in the above description or shown in the accompanying drawings shall be interpreted as illustrative only and not limiting. Changes in detail or structure can be made without departing from the spirit of the disclosure as defined in the appended claims.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

What is claimed:

1. An electronic cigarette, comprising:

a body portion, the body portion including a body proximal end and a body distal end, wherein the body portion includes an air inlet;

a mouth piece connected to the body proximal end;

an atomizer disposed in the body portion;

a backflow mitigation valve disposed in the body portion between the atomizer and the air inlet, wherein the backflow mitigation valve is closed in a naturally biased state, wherein the backflow mitigation valve remains in a closed state respective of an orientation of the electronic cigarette; and a porous material disposed between the backflow mitigation valve and the air inlet.

2. The electronic cigarette of claim 1, wherein the backflow mitigation valve is disposed in the body distal end.

3. The electronic cigarette of claim 1, further comprising a battery portion connected to the body distal end.

4. The electronic cigarette of claim 3, wherein the backflow mitigation valve is disposed in the battery portion.

5. The electronic cigarette of claim 3, wherein:

the battery portion includes a battery connector;

the battery connector is connected to the body distal end; and the backflow mitigation valve is disposed in the battery connector.

6. The electronic cigarette of claim 1, wherein the backflow mitigation valve is a duckbill valve.

7. The electronic cigarette of claim 1, wherein the backflow mitigation valve is a reed valve.

8. The electronic cigarette of claim 7, wherein the reed valve includes a double read valve.

9. The electronic cigarette of claim 1, wherein the backflow mitigation valve includes an umbrella valve.

10. The electronic cigarette of claim 1, wherein the backflow mitigation valve includes a spring ball valve.

11. The electronic cigarette of claim 1, wherein the porous material includes hydrophobic properties.

12. The electronic cigarette of claim 1, wherein the porous material includes oleophobic properties.

13. An electronic cigarette, comprising:

a body portion, the body portion including a body proximal end and a body distal end, wherein the body portion includes an air inlet;

a mouth piece connected to the body proximal end;

an atomizer disposed in the body portion;

a battery portion connected to the body distal end via a battery connector;

a backflow mitigation valve disposed in the battery connector, between the atomizer and the air inlet, wherein the backflow mitigation valve is a double duckbill valve, and wherein the double duckbill valve includes a pair of duckbill valves disposed orthogonal with respect to one another; and a porous material disposed between the backflow mitigation valve and the air inlet configured to prevent moisture from traveling towards the air inlet.

14. The electronic cigarette of claim 13, wherein the backflow mitigation valve is configured to allow air to enter the air inlet and prevent air from exiting the air inlet.

15. The electronic cigarette of claim 13, wherein the backflow mitigation valve is configured to prevent fluid from exiting the backflow mitigation valve.

16. An electronic cigarette, comprising:

a body portion, the body portion including a body proximal end and a body distal end, wherein the body portion includes an air inlet;

a mouth piece connected to the body proximal end;

an atomizer disposed in the body portion;

a battery portion connected to the body distal end via a battery connector;

a backflow mitigation valve disposed in the battery connector between the atomizer and the air inlet, wherein the backflow mitigation valve is formed from a flexible material, and wherein the backflow mitigation valve is closed in a naturally biased state, wherein the backflow mitigation valve remains in a closed state respective of an orientation of the electronic cigarette; and a porous material disposed between the backflow mitigation valve and the air inlet, wherein the porous material is an absorbent material.

17. The electronic cigarette of claim 16, wherein the backflow mitigation valve is formed from a material that includes rubber.

* * * * *